US008984681B2

(12) United States Patent
Ponsi

(10) Patent No.: US 8,984,681 B2
(45) Date of Patent: Mar. 24, 2015

(54) APPARATUS AND SYSTEM FOR TURNING AND POSITIONING A PATIENT

(75) Inventor: Larry Ponsi, Wheeling, IL (US)

(73) Assignee: Sage Products, LLC, Cary, IL (US)

( * ) Notice: Subject to any disclaimer, the term of this patent is extended or adjusted under 35 U.S.C. 154(b) by 533 days.

(21) Appl. No.: 13/156,103

(22) Filed: Jun. 8, 2011

(65) Prior Publication Data

US 2012/0186013 A1 Jul. 26, 2012

Related U.S. Application Data

(63) Continuation-in-part of application No. 13/014,497, filed on Jan. 26, 2011, now Pat. No. 8,850,634, and a continuation-in-part of application No. 13/014,500, filed on Jan. 26, 2011, now Pat. No. 8,789,533.

(51) Int. Cl.
*A61G 5/00* (2006.01)
*A61G 7/00* (2006.01)
(Continued)

(52) U.S. Cl.
CPC ..... *A61G 7/001* (2013.01); *A61G 7/0525* (2013.01); *A61G 7/1026* (2013.01)
USPC ..... 5/81.1 R; 5/420; 5/617; 128/845; 128/872; 128/876

(58) Field of Classification Search
CPC ... A61G 7/1026; A61G 7/1057; A61G 7/001; A61G 7/1051; A61G 7/0504; A61G 7/1025; A61G 7/1076; A61G 7/1036; A61G 1/01; A61G 7/1023; A61G 7/005; Y10S 5/926; A63B 21/1473
USPC ..... 5/81.1 HS, 81.1 T, 632, 633, 925, 926; 128/845
See application file for complete search history.

(56) References Cited

U.S. PATENT DOCUMENTS 1,334,901 A 3/1920 Higdon
3,333,286 A 8/1967 Biolik
(Continued)

FOREIGN PATENT DOCUMENTS

DE 102010007457 A1 8/2011
FR 2923367 5/2009
(Continued)

OTHER PUBLICATIONS

Office Action dated Mar. 20, 2013, in U.S. Appl. No. 13/014,500.
(Continued)

*Primary Examiner* — William Kelleher
*Assistant Examiner* — Myles Throop
(74) *Attorney, Agent, or Firm* — Banner & Witcoff, Ltd.

(57) ABSTRACT

A system for use with a bed having a frame and a supporting surface includes a base sheet having a top surface and a bottom surface adapted to be placed above the supporting surface, and a glide sheet positioned above the top surface of the base sheet. The base sheet has fasteners located around the peripheral edges, which are configured to releasably fasten the base sheet to the bed. The base sheet and the glide sheet each have a tether strap, and the tether straps are configured to be connected together to secure the glide sheet in place. One or both of the tether straps may include at least a portion that is elastic. The system may also include a wedge, where the wedge has a hook-and-loop or other releasable connecting material that is configured for connection to a complementary connecting material on the base sheet and/or the glide sheet.

27 Claims, 14 Drawing Sheets

(51) Int. Cl.
*A61G 7/05* (2006.01)
*A61G 7/10* (2006.01)

(56) References Cited

U.S. PATENT DOCUMENTS

| | | | | | |
|---|---|---|---|---|---|
| 3,452,372 | A | | 7/1969 | Emery | |
| 3,965,503 | A | * | 6/1976 | Gridel | 5/484 |
| 4,048,681 | A | | 9/1977 | Baulch et al. | |
| 4,214,326 | A | | 7/1980 | Spann | |
| 4,233,700 | A | * | 11/1980 | Spann | 5/632 |
| 4,662,016 | A | | 5/1987 | Seeman | |
| 4,675,925 | A | * | 6/1987 | Littleton | 5/607 |
| 4,802,249 | A | * | 2/1989 | Bills | 5/420 |
| 4,858,625 | A | * | 8/1989 | Cramer | 128/872 |
| 5,138,731 | A | * | 8/1992 | Harcrow, Jr. | 5/625 |
| 5,182,828 | A | | 2/1993 | Alivizatos | |
| 5,193,238 | A | * | 3/1993 | Clute | 5/655 |
| 5,329,655 | A | | 7/1994 | Garner | |
| 5,448,790 | A | | 9/1995 | Saro et al. | |
| RE35,468 | E | | 3/1997 | Newman | |
| 6,154,900 | A | * | 12/2000 | Shaw | 5/81.1 R |
| 6,560,793 | B2 | * | 5/2003 | Walker | 5/81.1 T |
| 6,658,676 | B1 | | 12/2003 | Persson et al. | |
| 6,804,845 | B2 | | 10/2004 | Stewart et al. | |
| 6,874,176 | B2 | | 4/2005 | Berge | |
| 7,240,384 | B2 | | 7/2007 | DuDonis | |
| 7,506,387 | B1 | | 3/2009 | Scordato et al. | |
| 7,571,498 | B2 | | 8/2009 | Jewell et al. | |
| 8,161,583 | B1 | | 4/2012 | Palen | |
| 8,789,533 | B2 | * | 7/2014 | Steffens et al. | 128/845 |
| 2001/0040402 | A1 | | 11/2001 | Odderson | |
| 2002/0029417 | A1 | * | 3/2002 | Walker | 5/81.1 R |
| 2005/0055768 | A1 | | 3/2005 | Assink | |
| 2005/0229314 | A1 | | 10/2005 | Chisari | |
| 2006/0213010 | A1 | * | 9/2006 | Davis | 5/626 |
| 2010/0257703 | A1 | | 10/2010 | Vass | |
| 2011/0304186 | A1 | | 12/2011 | Andrews | |
| 2012/0186587 | A1 | | 7/2012 | Steffens et al. | |
| 2014/0304918 | A1 | * | 10/2014 | Steffens et al. | 5/617 |

FOREIGN PATENT DOCUMENTS

| | | | |
|---|---|---|---|
| GB | 2300845 | A | 11/1996 |
| JP | 10117907 | | 5/1998 |
| WO | 8810082 | A1 | 12/1988 |
| WO | 9627357 | | 9/1996 |
| WO | 02065877 | A1 | 8/2002 |
| WO | 2004050002 | | 6/2004 |

OTHER PUBLICATIONS

Office Action dated Jul. 2, 2013, in U.S. Appl. No. 13/014,497.
ISR/WO mailed Dec. 4, 2012, from PCT Application No. PCT/US2012/041729.
May 15, 2014—(WO) International Search Report and Written Opinion—App PCT/US12/22572.
IPRP dated Dec. 10, 2013 from PCT/US2012/041729.
Jul. 12, 2013—(WO) International Search Report and Written Opinion—App PCT/US2013/036448.

* cited by examiner 12
86A
83
23
20
30
90
86B
13
84B
84
83
84
85
21
81
80
18
16
10
14
83

12
18
80
16
21
20
81
80
86A
86B
30
84B
84
84A
90
84A
14
10
83
13

APPARATUS AND SYSTEM FOR TURNING AND POSITIONING A PATIENT

CROSS-REFERENCE TO RELATED APPLICATIONS

This application is a continuation-in-part of U.S. patent application Ser. No. 13/014,497, filed Jan. 26, 2011, and is also a continuation-in-part of U.S. patent application Ser. No. 13/014,500, filed Jan. 26, 2011, which prior applications are incorporated by reference herein in their entireties and made part hereof.

TECHNICAL FIELD

The present invention generally relates to an apparatus, system, and method for turning and positioning a person supine on a bed or the like, and, more particularly, to a system that includes one or more of a base sheet, a glide sheet, an absorbent pad, and/or a wedge, as well as methods including one or more of such apparatuses.

BACKGROUND

Nurses and other caregivers at hospitals, assisted living facilities, and other locations often care for bedridden patients that have limited or no mobility, many of whom are critically ill or injured. These immobile patients are at risk for forming pressure ulcers (bed sores). Pressure ulcers are typically formed by one or more of several factors. Pressure on a patient's skin, particularly for extended periods of time and in areas where bone or cartilage protrudes close to the surface of the skin, can cause pressure ulcers. Frictional forces and shearing forces from the patient's skin rubbing or pulling against a resting surface can also cause pressure ulcers. Excessive heat and moisture can cause the skin to be more fragile and increase the risk for pressure ulcers. One area in which pressure ulcers frequently form is on the sacrum, because a patient lying on his/her back puts constant pressure on the sacrum, and sliding of the patient in a bed can also cause friction and shearing at the sacrum. Additionally, some patients need to rest with their heads inclined for pulmonary reasons, which can cause patients to slip downward in the bed and cause further friction or shearing at the sacrum and other areas. Existing devices and methods often do not adequately protect against pressure ulcers in bedridden patients, particularly pressure ulcers in the sacral region.

One effective way to combat sacral pressure ulcers is frequent turning of the patient, so that the patient is resting on one side or the other, and pressure is taken off of the sacrum. Pillows that are stuffed partially under the patient are often used to support the patient's body in resting on their left or right sides. A protocol is often used for scheduled turning of bedridden patients, and dictates that patients should be turned Q2, or every two hours, either from resting at a 30° angle on one side to a 30° angle on the other side, or from 30° on one side to 0°/supine (lying on his/her back) to 30° on the other side. However, turning patients is difficult and time consuming, typically requiring two or more caregivers, and can result in injury to caregivers from pushing and pulling the patient's weight during such turning. As a result, ensuring compliance with turning protocols, Q2 or otherwise, is often difficult. Additionally, the pillows used in turning and supporting the patient are non-uniform and can pose difficulties in achieving consistent turning angles, as well as occasionally slipping out from underneath the patient.

Care of patients having large size and/or weight can involve many of the same problems and issues described above, and may also present further difficulty due to the larger size and/or weight of the patients. This can result in greater strain on both equipment and caregivers, as well as increased difficulty in properly positioning the patient. Additionally, sometimes large patients require use of specialized beds that are wider and have a higher weight capacity.

The present invention seeks to overcome certain of these limitations and other drawbacks of existing devices, systems, and methods, and to provide new features not heretofore available.

BRIEF SUMMARY

The present invention relates generally to systems for turning and positioning persons in a supine position, such as a patient in a hospital bed. Aspects of the invention relate to a device or system for use with a bed having a frame and a supporting surface supported by the frame, the system including a base sheet having a bottom surface adapted to be placed above the supporting surface of the bed and a top surface opposite the bottom surface, the top and bottom surfaces being defined by peripheral edges of the sheet. The base sheet has a piece of releasable connecting material (e.g. hook-and-loop) that is connected to the top surface of the base sheet and is spaced inwardly from one of the peripheral edges of the base sheet. The base sheet also has a flap positioned proximate the piece of releasable connecting material and having a fixed end connected to the top surface of the base sheet, in an area located between the connecting material and the first peripheral edge of the base sheet, and a free end opposite the fixed end. The free end of the flap can be folded over the piece so that the flap at least partially covers the connecting material. In one embodiment, the flap may have sufficient size such that the free end can be folded over to completely cover the connecting material.

According to one aspect, the sheet has another piece of releasable connecting material connected to the top surface of the sheet and spaced inwardly from a second of the peripheral edges of the sheet opposite the first edge, and also has a second flap positioned proximate the second piece of releasable connecting material. The second piece of connecting material and the corresponding second flap are configured in the same way as the first piece of connecting material and the corresponding flap described above. In one embodiment, the pieces of connecting material are both elongated along directions substantially parallel to the respective adjacent peripheral edges of the sheet, with each having two opposed elongated edges. The flaps each have their fixed ends connected to the top surface of the sheet along one of the elongated edges of the corresponding piece of connecting material that is most proximate to the respective adjacent peripheral edge of the sheet. The flaps may be rectangular and elongated along the direction substantially parallel to the respective adjacent peripheral edge of the sheet.

According to another aspect, the sheet further includes a plurality of fasteners located around the peripheral edges of the sheet. The fasteners are configured to releasably fasten the sheet to the bed. The fasteners may include connection straps extending from the peripheral edges and configured for releasably fastening the sheet to the bed, such that at least some of the connection straps have complementary connectors (e.g. buckles, snaps, etc.) for connection to each other to releasably fasten the sheet to the bed. The sheet may also include a tether strap connected to the sheet and extending from the sheet, such that the tether strap is configured to be releasably connected to a glide sheet placed over the top surface of the sheet.

Additional aspects of the invention relate to a system that includes a base sheet having a bottom surface adapted to be placed above the supporting surface of the bed and a top surface opposite the bottom surface, and a glide sheet positioned above the top surface of the base sheet. The base sheet has a plurality of fasteners located around the peripheral edges, where the fasteners are configured to releasably fasten the base sheet to the bed. A first tether strap is connected to the base sheet and extends from the base sheet, and a second tether strap is connected to the glide sheet and extending from the glide sheet. The first tether strap and the second tether strap have complementary connecting structures, such that the first strap is configured to be connected to the second strap to hold the glide sheet in position relative to the base sheet. Additionally, at least one of the tether straps includes an elastic portion forming at least a portion of a length thereof.

According to one aspect, the first tether strap and the second tether strap have complementary releasable connecting structures, such as a hook-and-loop connecting structure.

According to another aspect, the system also includes a wedge having a base wall, a ramp surface, an apex formed by the base wall and the ramp surface, and a back wall opposite the apex, with the ramp surface being positioned at an angle to the base wall. The wedge is configured to be positioned between the base sheet and the glide sheet, such that the base wall confronts the top surface of the base sheet and the ramp surface confronts a bottom surface of the glide sheet. The system may also include a piece of releasable connecting material connected to the top surface of the base sheet and a flap positioned proximate the first piece, as described above. The system may further include another piece of releasable connecting material connected to the base wall of the wedge, where the releasable connecting materials of the first and second pieces are complementary. In this configuration, the wedge and the base sheet are configured such that, upon insertion of the wedge between the base sheet and the glide sheet from the adjacent peripheral edge of the base sheet, the apex of the wedge pushes the flap away from the first peripheral edge to cover the piece of connecting material, and a subsequent force exerted on the wedge toward the peripheral edge causes the flap to be pushed toward the first peripheral edge to expose at least a portion of the connecting material, causing the second piece to become connected to an exposed portion of the connecting material to resist further movement of the wedge toward the first peripheral edge. Still further, the bottom surface of the glide sheet and the back wall of the wedge may include complementary releasable connecting materials, such that when the apex of the wedge is fully inserted between the base sheet and the glide sheet, a portion of the glide sheet including the connecting material drapes over the back wall of the wedge and the connecting materials can be connected to resist movement of the wedge and the glide sheet relative to each other.

According to a further aspect, the bottom surface of the glide sheet has a low friction surface forming at least a portion of the bottom surface, and the top surface has a high friction surface forming at least a portion of the top surface, such that the top surface provides greater slipping resistance than the bottom surface. In one embodiment, the top surface of the base sheet has a low friction surface forming at least a portion of the top surface, such that the low friction surface of the base sheet and the low friction surface of the glide sheet are formed by the same low friction material.

Further aspects of the invention relate to a system that includes a base sheet having a bottom surface adapted to be placed above the supporting surface of the bed and a top surface opposite the bottom surface and a wedge that includes a base wall, a ramp surface, an apex formed by the base wall and the ramp surface, and a back wall opposite the apex, with the ramp surface being positioned at an angle to the base wall. The base sheet has a piece of releasable connecting material connected to the top surface and spaced inwardly from one of the peripheral edges, and the wedge has a complementary piece of releasable connecting material connected to the base wall. The wedge is configured to be positioned over the base sheet, such that the base wall confronts the top surface of the base sheet. Upon placement of the wedge over the base sheet proximate the peripheral edge of the base sheet, the connecting material of the wedge becomes connected to the connecting material of the base sheet to resist movement of the wedge toward the peripheral edge.

According to one aspect, the base sheet includes a flap positioned proximate the connecting material, which can be folded over to cover the connecting material of the base sheet, as described above. Upon placement of the wedge over the base sheet by sliding the wedge from the peripheral edge of the base sheet, the apex of the wedge pushes the flap away from the first peripheral edge to cover the first piece. A subsequent force exerted on the wedge toward the peripheral edge causes the flap to be pushed toward the peripheral edge to expose at least a portion of the first piece, causing the second piece to become connected to the exposed portion of the first piece to resist further movement of the wedge toward the first peripheral edge.

According to another aspect, the system also includes a glide sheet positioned above the top surface of the base sheet. The wedge is configured to be placed between the base sheet and the glide sheet. The glide sheet may include another piece of releasable connecting material connected to a bottom surface, and the wedge may have a complementary piece of releasable connecting material connected to the back wall. As described above, a portion of the glide sheet may drape over the back wall of the wedge so that the complementary connecting materials become connected to resist movement of the wedge and the glide sheet relative to each other.

According to a further aspect, the wedge is formed of a body made from a compressible foam material defining the base wall, the ramp surface, the apex, and the back wall. The connecting material of the wedge is connected to the body, and the wedge further includes a low-friction material connected to the body and forming at least a portion of the ramp surface.

Other features and advantages of the invention will be apparent from the following specification taken in conjunction with the following drawings.

DETAILED DESCRIPTION

Figure 1:
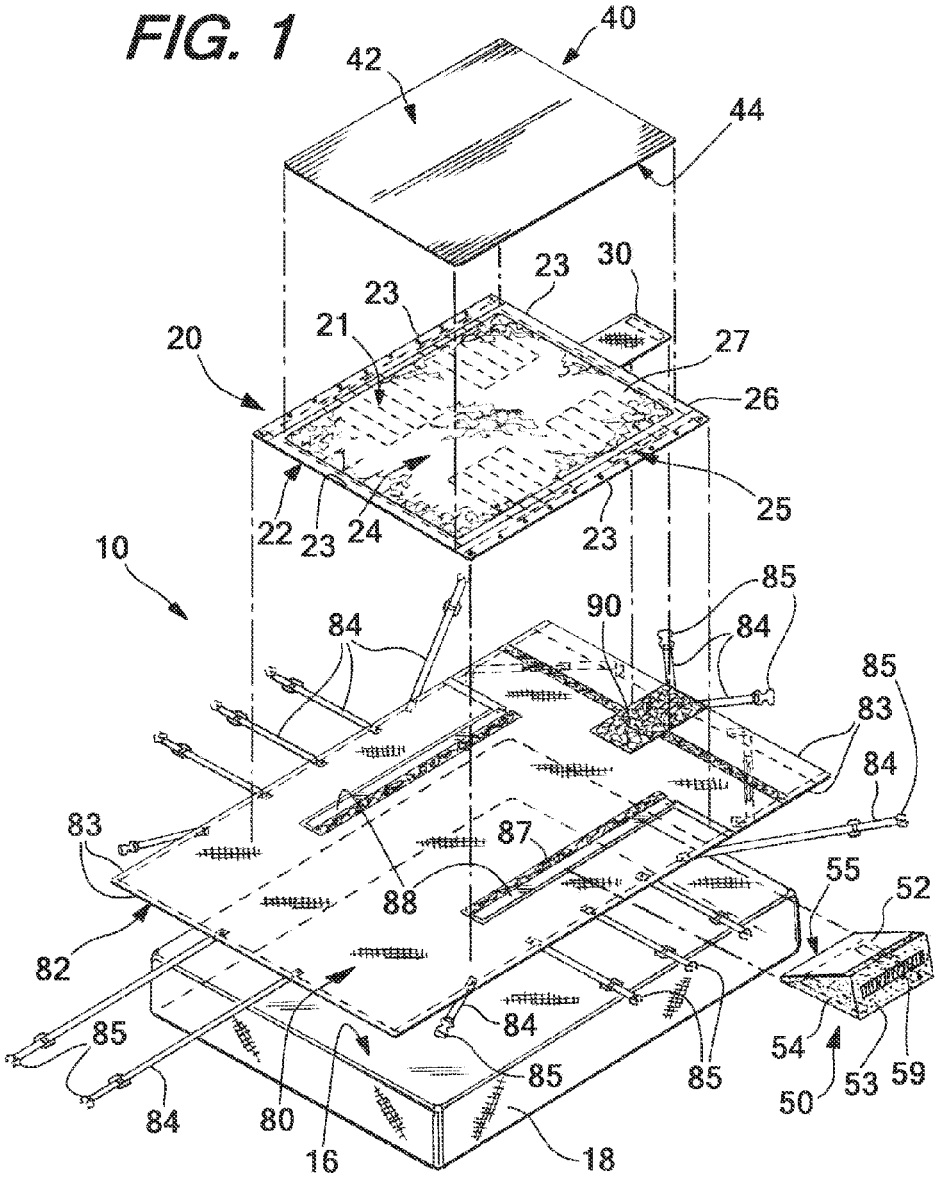
FIG. 1 is an exploded perspective view of one embodiment of a system for use in turning and positioning a patient, according to aspects of the invention.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

In general, the invention relates to one or more apparatuses or devices, including a base sheet configured for connection to a bed, a glide sheet having a high friction or gripping surface and/or a low friction or slipping surface, an absorbent body pad configured to be placed over the glide sheet, and one or more wedges configured to be placed underneath the sheet to support the patient in an angled position, as well as systems including one or more of such devices and methods utilizing one or more of such systems and/or devices. Various embodiments of the invention are described below.

Referring now to the figures, and initially to FIGS. 1-5, there is shown an exemplary embodiment of a system 10 for use in turning and positioning a person in a supine position, such as a patient lying on a hospital bed. As shown in FIG. 1, the system 10 includes a base sheet 80, a glide sheet 20 positioned over the base sheet 80, an absorbent body pad 40 configured to be placed over the glide sheet 20, and one or more wedges 50 configured to be placed under the glide sheet 20, such as between the glide sheet 20 and the base sheet 80. The patient can be positioned on top of the body pad 40, with the body pad 40 lying on the glide sheet 20 and the glide sheet 20 lying on the base sheet 80, and with one or more wedges 50 optionally positioned between the glide sheet 20 and the base sheet 80.

Figures 4, 5:
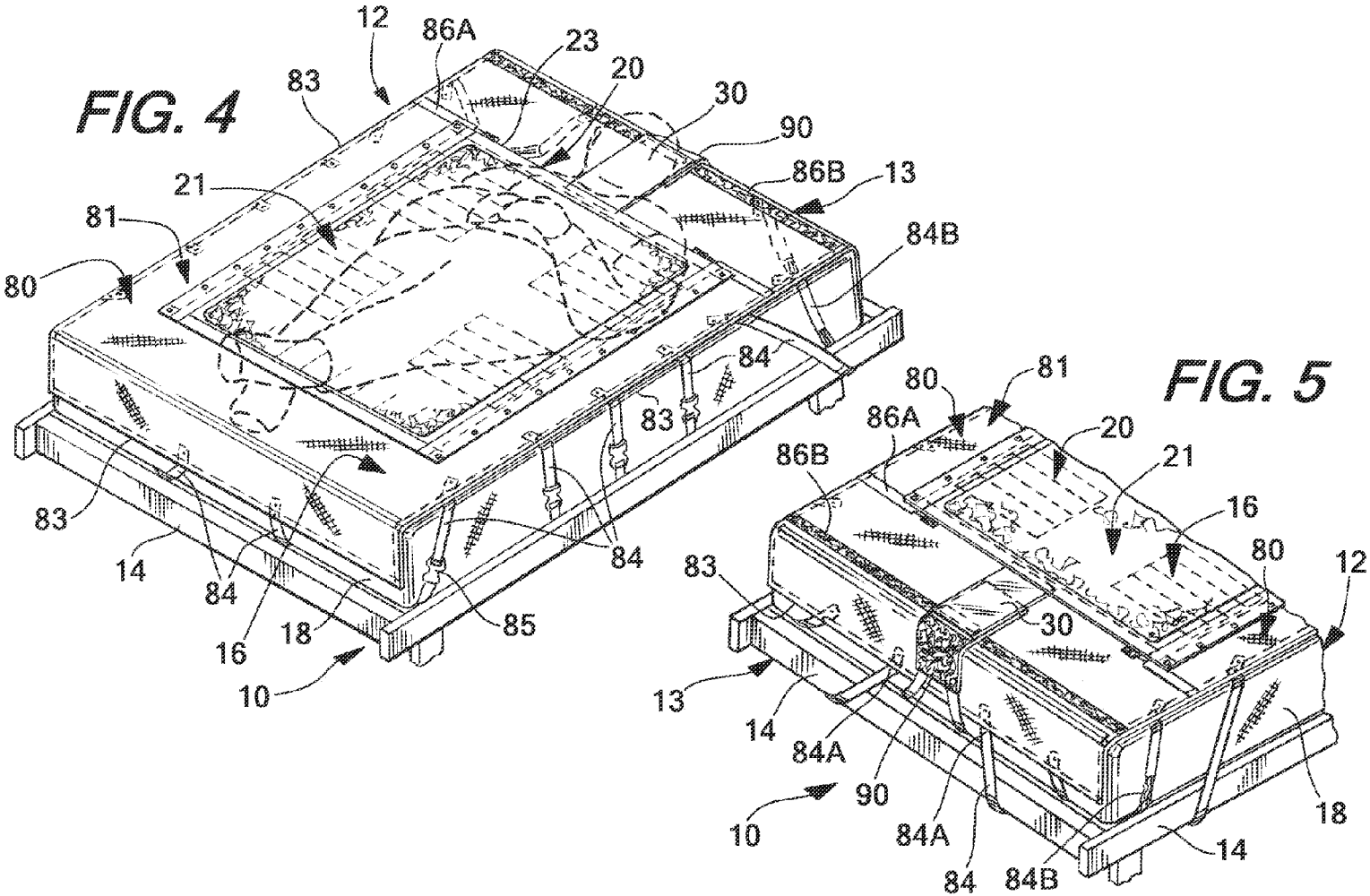
FIG. 4 is a perspective view of the base sheet and the glide sheet of FIG. 1 resting on a supporting surface of a bed, with a potential position of a patient illustrated in broken lines.
FIG. 5 is a rear perspective view of a head of the bed of FIG. 4, along with portions of the base sheet and glide sheet.
Figure 16:
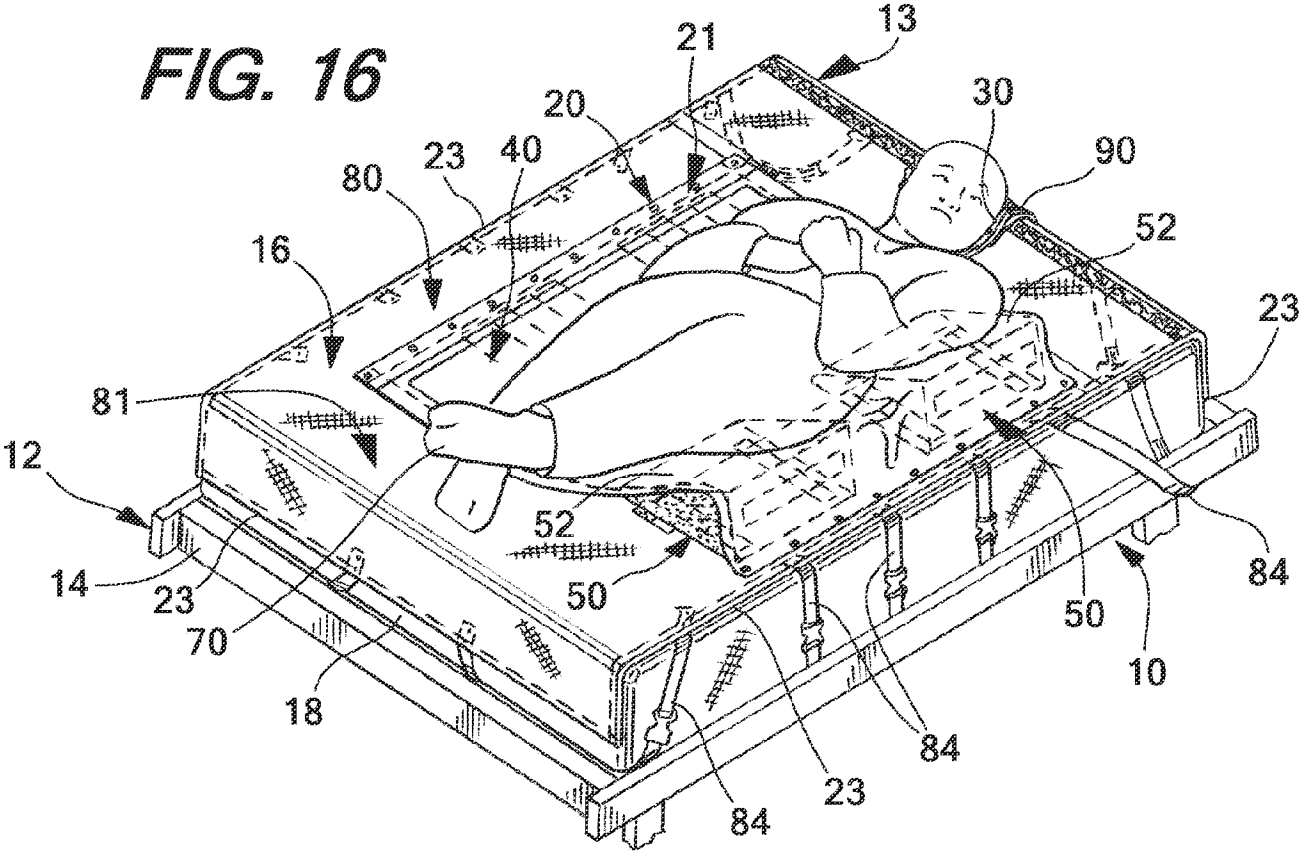
FIG. 16 is a perspective view of the system of FIG. 9 after successful placement of the wedges to support the patient.

As shown in FIGS. 4 and 16, the system 10 is configured to be placed on a bed 12 or other support apparatus for supporting a person 70 in a supine position. The bed 12 generally includes a frame 14 and a supporting surface 16 supported by the frame 14, as shown in FIGS. 4-5. The supporting surface 16 can be provided by a mattress 18 or similar structure, and in various embodiments, the mattress 18 can incorporate air pressure support, alternating air pressure support and/or low-air-loss (LAL) technology. These technologies are known in the art, and utilize a pump motor or motors (not shown) to effectuate airflow into, over and/or through the mattress 18. The air aids in supporting the patient, and the top of the mattress 18 may be breathable so that the airflow can pull heat and moisture vapor away from the patient. The bed 12 may also include a bed sheet (not shown) such as a fitted sheet or flat sheet, as well as pillows, blankets, additional sheets, and other components known in the art. Further, the bed 12 may be an adjustable bed, such as a typical hospital-type bed, where the head 13 (or other parts) of the bed 12 can be raised and lowered, such as to incline the patient's upper body. It is understood that the system 10 and the components thereof can be used with other types of beds 12 as well. For patients of larger sizes, larger beds may be used. For example, a standard hospital-type bed is typically 35-36 inches wide, and for larger patients, a bed that is 40-50 inches wide may be used.

Figure 2:
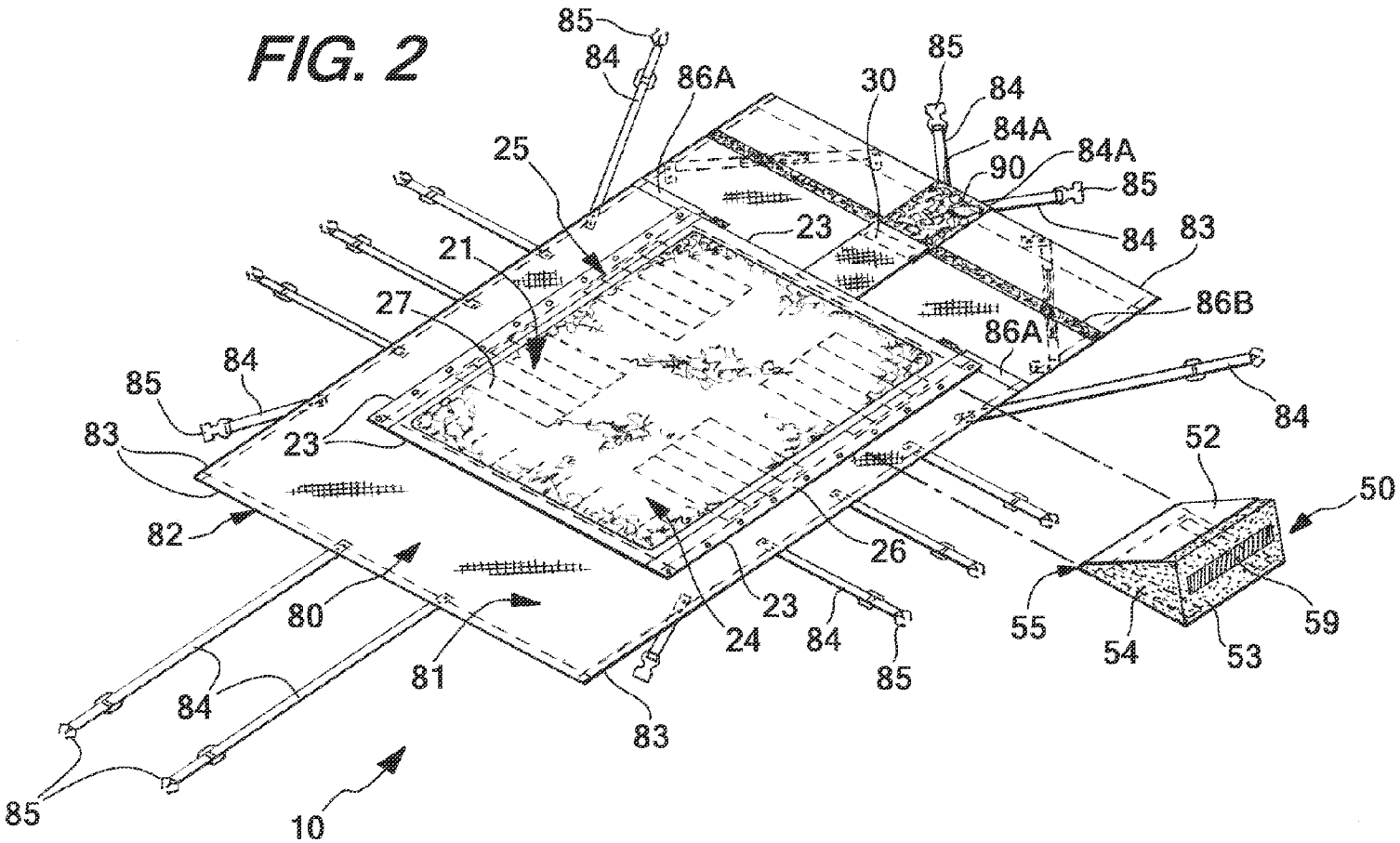
FIG. 2 is a perspective view of a base sheet, a glide sheet, and a wedge of the system of FIG. 1.
Figure 3:
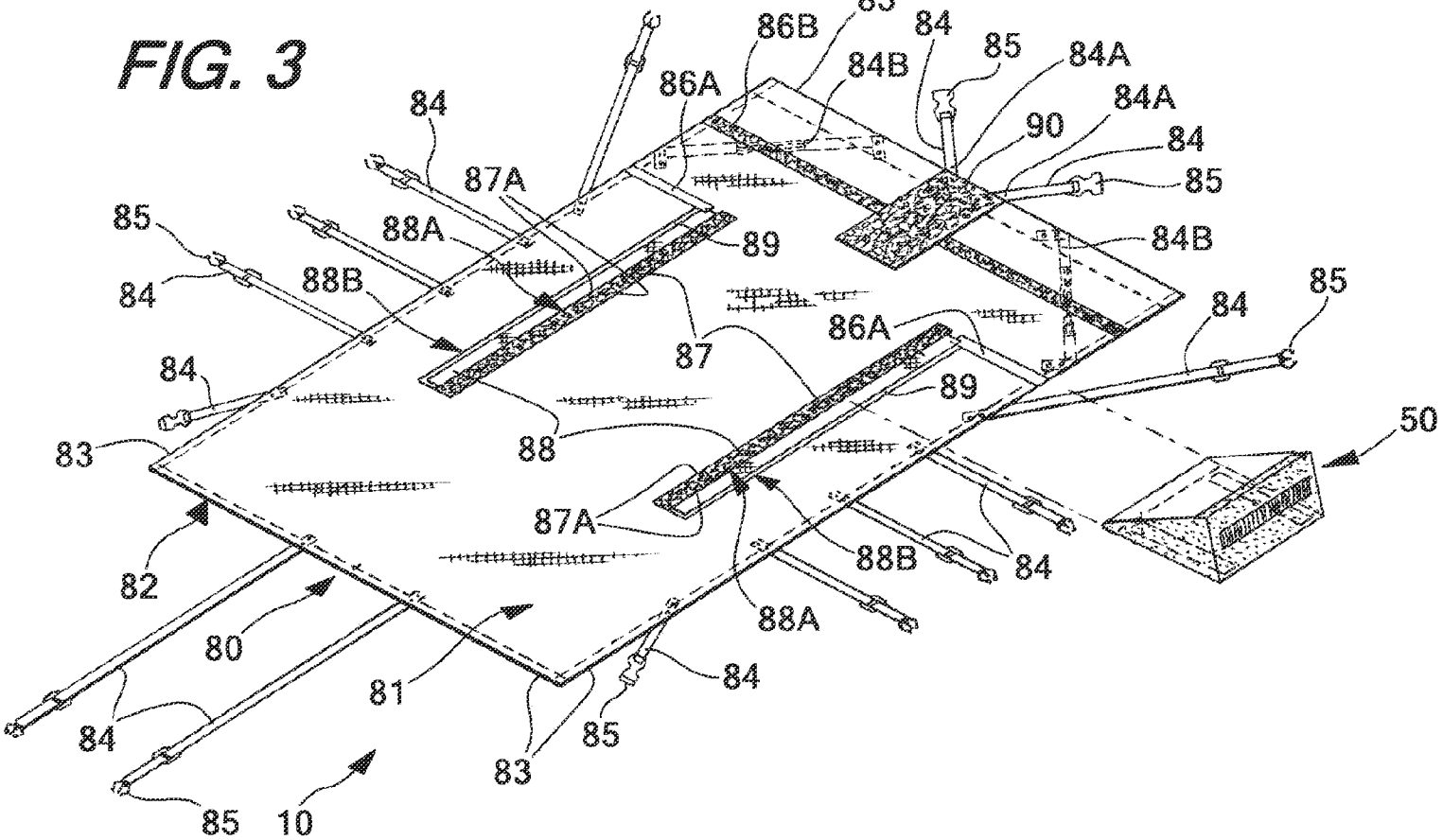
FIG. 3 is a perspective view of the base sheet and the wedge of FIG. 1.

An example embodiment of the base sheet 80 is shown in greater detail in FIGS. 2-4. In general, the base sheet 80 is flexible and foldable, and has a top surface 81 and a bottom surface 82 defined by a plurality of peripheral edges 83. As seen in FIGS. 1-4, the base sheet 80 in this embodiment is rectangular, having four peripheral edges 83, but could have a different shape in other embodiments. The base sheet 80 is configured to be positioned on the bed 12 so that the bottom surface 82 is above the supporting surface 16 of the bed 12 and faces or confronts the supporting surface 16, and is supported by the supporting surface 16. As used herein, "above," "below," "over," and "under" do not imply direct contact or engagement. For example, the bottom surface 82 being above the supporting surface 16 means that that the bottom surface 82 may be in contact with the supporting surface 16, or may face or confront the supporting surface 16 and/or be supported by the supporting surface 16 with one or more structures located between the bottom surface 22 and the supporting surface 16, such as a bed sheet as described above. Likewise, "facing" or "confronting" does not imply direct contact or engagement, and may include one or more structures located between the surface and the structure it is confronting or facing. In one embodiment, the base sheet 80 may be configured for use with larger beds, such as beds that are 40-50 inches wide, and may have a width of approximately 58 inches. In this configuration, the 58-inch base sheet 80 would overlap the sides of a 50-inch mattress by 4 inches on each side.

In this embodiment, the base sheet 80 is formed primarily of a low-friction or sliding material, which may include polyester and/or nylon (polyamide), as similarly described below with respect to the glide sheet 20. The low friction material may additionally or alternately be formed of other materials. At least a portion of the top surface 81 and at least a portion of the bottom surface 82 of the base sheet 80 are formed of the low friction material in this embodiment, and the base sheet may be made substantially entirely of the low friction material, with other materials connected to the low friction material. In other embodiments, the base sheet 80 may not include the low friction material on one or both surfaces 81, 82, and/or may contain a smaller or larger proportion of the low friction material.

The base sheet 80 in this embodiment has a fastening assembly that includes a plurality of fasteners 84 around the peripheral edges 83, configured for releasably fastening the base sheet 80 to the bed 12. As shown in FIGS. 2-5, the fasteners 84 are in the form of a plurality of straps that extend from the edges 83 of the base sheet 80. Some of the straps 84 in this embodiment have buckles 85 for connecting to themselves, connecting to a portion of the bed 12 (such as another strap connected to the bed 12) or for connecting to other straps, and may be configured for wrapping around portions of the bed 12, including portions of the frame 14 and/or mattress 18. Two straps 84 proximate the top edge 83 of the base sheet 80 have ends 84A that are close to the centerline of the base sheet 80, which is described in greater detail below. Some other straps 84 may not include buckles 85, such as the corner straps 84B, which are made from an elastic material and are designed to be stretched underneath corners of the mattress 18. In other embodiments, different types of fasteners 84 or a different type of fastening assembly may be utilized, which may contain different fastening or connecting structures. For example, in one embodiment, a drawstring or other tightening apparatus connected around the edges 83 of the base sheet 80, which can be tightened or cinched around the perimeter of the mattress 18 and/or another part of the bed 12, may function as a fastening assembly.

The base sheet 80 may also contain positioning markers 86A-B, as in the embodiment shown in FIGS. 1-5. In this embodiment, two positioning markers 86A indicate where the top peripheral edge 23 of the glide sheet 20 should be aligned when the glide sheet 20 is placed on top of the base sheet 80, as described below. Additionally, another positioning marker 86B indicates approximately where the base sheet 80 should be aligned with the head 13 of the bed 12 when placed over the supporting surface 16.

In the embodiment shown in FIGS. 1-5, the base sheet 80 also includes pieces of a releasable connecting material 87, such as a hook-and-loop connecting material, connected to the top surface 81 (e.g. by stitching). The pieces of the releasable connecting material 87 are shown in the form of elongated strips 87 of hook-and-loop connecting material connected to the top surface 81 in the embodiment of FIGS. 1-5. As shown in FIGS. 1 and 3, the strips 87 are spaced inwardly from the two opposed left and right peripheral edges 83 of the base sheet 80, and have elongated edges 87A forming a direction of elongation that runs substantially parallel to the respective peripheral edges 83. In other embodiments, the pieces of connecting material 87 may have different forms, structures, and/or configurations, such as being in the form of intermittent patches of the connecting material, or other configurations. Further, other types of connecting materials may be utilized as part or all of the connecting material 87 and other connecting materials described herein. Such connecting materials may include other releasable connecting structures, and may also include materials that limit movement of the structures in one or more directions. For example, the connecting material may include a material that resists movement in at least one direction or along at least one axis, while allowing movement in at least one other direction or along at least one other axis. Such directionally-oriented materials may include complementary materials that cooperate to limit movement in one or more directions.

The embodiment of the base sheet 80 in FIGS. 1-5 also has flaps 88 connected to the top surface 81, which are configured for covering part or all of the pieces of connecting material 87. In this embodiment, each of the two pieces of connecting material 87 has an adjacent flap 88. Each flap 88 is flexible and has a fixed end or edge 88A connected to the top surface 81 of the base sheet 80 (e.g. by stitching) and a free end or edge 88B that is moveable to allow the flap 88 to fold over upon itself. As shown in greater detail in FIG. 3, the flaps 88 each have the fixed end 88A positioned adjacent and substantially parallel to one of the elongated edges 87A of the strips 87, between the respective strip 87 and the most proximate peripheral edge 83 (i.e. left or right edge 83) of the base sheet 80. The flaps 88 are foldable, such that the free ends 88B can be folded over the adjacent strips 87 to cover at least a portion of each of the strips 87. In the embodiment shown, the flaps 88 have sufficient size (elongated length and/or width measured transverse to the length) so that when the free ends 88B are folded over, the flaps 88 completely cover the strips of connecting material 87. Additionally, the flaps 88 are each elongated in the same direction as the strips 87 in the embodiment shown in FIGS. 1-5. The flaps 88 may also have reinforcing material 89 positioned around the edges, which can add stiffness/structural reinforcement, as well as increasing durability. The reinforcing material 89 may additionally or alternately provide a surface to enhance gripping of the flap 88, to allow the wedge 50 to push the flap 88 over the connecting material 87 or to pull the flap 88 backward to expose a portion of the connecting material 87, as described below. In one embodiment, the reinforcing material 89 is connected around at least a portion of the free end 88B of the flap 88, and may be connected around the entire free end 88B, as well as the sides extending between the free end 88B and the fixed end 88A. The reinforcing material 89 may be nylon or other woven material, and may be the same material as the handles 28 of the glide sheet 20, described below. The flaps 88 may be made primarily from the same material as the base sheet 80, such as the low friction material described herein, or may be formed of a different material. In other embodiments, the flaps 88 may have a different configuration. For example, the flaps 88 may have fixed ends 88A that are spaced farther from the edges 87A of the strips 87, and may be larger in size to permit the flaps 88 to completely cover the strips 87. Other configurations are possible.

The base sheet 80 and the glide sheet 20 each contain connecting members that have connecting structures that are configured for complementary connection to each other, such as complementary releasable connecting materials (e.g. hook-and-loop connection). The base sheet 80 has a connecting member in the form of a tether strap 90 that is positioned at the top peripheral edge 83 of the base sheet 80, which is configured to be positioned at the head 13 of the bed 12. The strap 90 may be made from a single piece or multiple pieces. In the embodiment of FIGS. 1-5, the strap 90 is formed from a single piece of substantially non-elastic material that has little to no stretchability, and has a fixed end connected to the base sheet 80 and a free end opposite the fixed end. In another embodiment, the strap 90 may include at least a portion made from an elastic material, such as a variable force elastic material that allows initial stretching for a distance (e.g. 2-3 inches) and then provides increased resistance to stretching. As shown in FIGS. 1-3, the strap 90 is stitched to the base sheet 80 at the fixed end and is formed of a material that is able to constitute a loop structure for hook-and-loop connection, allowing the strap 90 to be connected with complementary hook-and-loop connections. As described in greater detail below, the connecting member (e.g. strap 90) of the base sheet 80 is configured for connection to a connecting member of the glide sheet 20, using complementary releasable connecting materials (e.g. hook-and-loop connection). As described below, the connecting member of the glide sheet 20 may be in the form of a tether strap 30. In another embodiment, only one of the base sheet 80 and the glide sheet 20 may contain a tether strap 30, 90, and the other one of the sheets 20, 80 may include a different type of connecting member, such as a patch of connecting material (e.g. a patch of hook-and-loop material) that is configured for connection to the tether strap 30, 90. In a further embodiment, both the base sheet 80 and the glide sheet 20 may include different types of connecting members.

Figure 6:
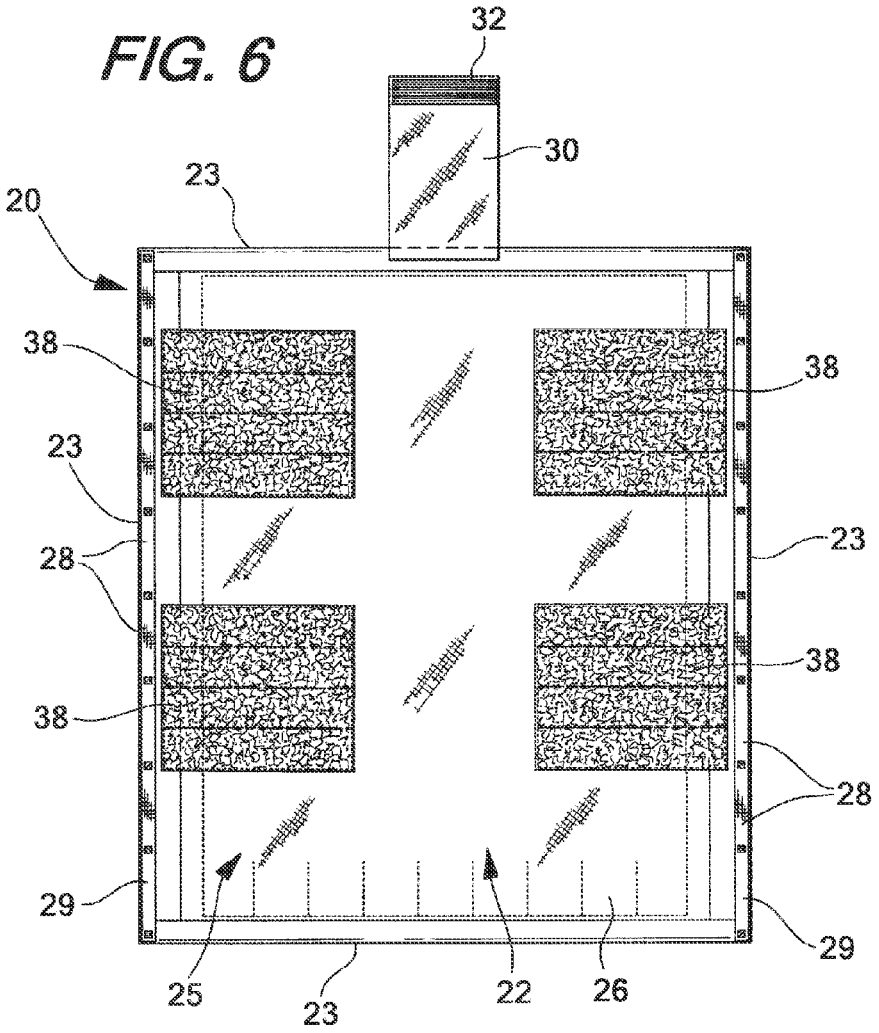
FIG. 6 is a bottom view of the glide sheet of FIG. 1.

An example embodiment of the glide sheet 20 is shown in greater detail in FIGS. 2 and 6. In general, the glide sheet 20 is flexible and foldable, and has a top surface 21 and a bottom surface 22 defined by a plurality of peripheral edges 23. As seen in FIGS. 1-2 and 4-6, the glide sheet 20 in this embodiment is rectangular, having four peripheral edges 23, but could be a different shape in other embodiments. The top surface 21 has at least a portion formed of a high-friction or gripping material 24, and the bottom surface 22 has at least a portion formed of a low-friction or sliding material 25. In this embodiment, the sheet includes a first piece 26 of sheet material that is formed partially or entirely of the low-friction material 25, with a second piece 27 of sheet material that is formed partially or entirely of the high-friction material 24, with the second piece 27 connected to the first piece 26 in a surface-to-surface, confronting relation to form a layered structure. As illustrated in FIGS. 1-2 and 4-6, the first piece 26 is larger than the second piece 27, so that the first piece 26 forms the entire bottom surface 22 of the sheet 20, and the second piece 27 forms at least a majority portion of the top surface 21, with the edges of the second piece 27 being recessed from the edges 23 of the sheet 20. In other words, in this embodiment, the glide sheet 20 is primarily formed by the first piece 26, with the second piece 27 connected to the first piece 26 to form at least a part of the top surface 21. In another embodiment, the first piece 26 forms at least a majority portion of the bottom surface 22, and the second piece 27 forms at least a majority portion of the top surface 21. The pieces 26, 27 are connected by stitching in one embodiment, but may have additional or alternate connections in other embodiments, including adhesives, sonic welding, heat welding and other techniques, including techniques familiar to those skilled in the art. Additionally, the low-friction material 25 and/or the high-friction material 24 may be formed by multiple pieces in other embodiments. For example, the first piece 26 made of the low-friction material 25 may have a plurality of strips or patches of the high-friction material 24 connected on the top surface 21 in one embodiment. In a further embodiment, the high friction material 24 may be or include a coating applied to the low friction piece 26, such as a spray coating. As described in greater detail below, the low-friction material 25 permits sliding of the glide sheet 20 in contact with the base sheet 80, and the high-friction material 24 provides increased resistance to slipping or sliding of the patient and/or the body pad 40 on which the patient may be lying, in contact with the glide sheet 20.

As shown in the embodiment in FIGS. 1-2, the first piece 26 is made substantially entirely of the low-friction material 25. In one embodiment, the low-friction material 25 is at least partially made from polyester and/or nylon (polyamide), although other materials can be used in addition to or instead of these materials. In one embodiment, the high friction material 24 is a warp knit tricot material that may be brushed, napped, and/or sanded to raise its pile, which can enhance comfort, and may be made of polyester and/or another suitable material. The material 24 can then be treated with a high friction substance, such as a hot melt adhesive or appropriate plastic, which can be applied as a discontinuous coating to promote breathability. The material 24 can also be treated with a water repellant, such as PTFE. In other embodiments, the high-friction material 24 may include any combination of these components, and may contain other components in addition to or instead of these components. Additionally, both the first and second pieces 26, 27 may be breathable in one embodiment, to allow passage of air, heat, and moisture vapor away from the patient.

Generally, the high friction material 24 has a coefficient of friction that is higher than the coefficient of friction of the low friction material 25. In one embodiment, the coefficient of friction for the high friction material 24 is about 8-10 times higher than the coefficient of friction of the low friction material 25. In another embodiment, the coefficient of friction for the high friction material 24 is between 5 and 10 times higher, or at least 5 times higher, than the coefficient of friction of the low friction material 25. The coefficient of friction, as defined herein, can be measured as a direct proportion to the pull force necessary to move either of the materials 24, 25 in surface-to-surface contact with the same third material, with the same normal force loading. Thus, in the embodiments above, if the pull force for the high friction material 24 is about 8-10 times greater than the pull force for the low friction material 25, with the same contact material and normal loading, the coefficients of friction will also be 8-10 times different. It is understood that the coefficient of friction may vary by the direction of the pull force, and that the coefficient of friction measured may be measured in a single direction. For example, in one embodiment, the above differentials in the coefficients of friction of the high friction material 24 and the low friction material 25 may be measured as the coefficient of friction of the low friction material 25 based on a pull force normal to the side edges 23 (i.e. proximate the handles 28) and the coefficient of friction of the high friction material 24 based on a pull force normal to the top and bottom edges 23 (i.e. parallel to the side edges 23).

Additionally, the coefficient of friction of the interface between the high-friction material 24 and the pad 40 is greater than the coefficient of friction of the interface between the low friction material 25 and base sheet 80 or the supporting surface 16. It is understood that the coefficients of friction for the interfaces may also be measured in a directional orientation, as described above. In one embodiment, the coefficient of friction for the interface of the high friction material 24 is about 8-10 times higher than the coefficient of friction of the interface of the low friction material 25. In another embodiment, the coefficient of friction for the interface of the high friction material 24 is between 5 and 10 times higher, or at least 5 times higher, than the coefficient of friction of the interface of the low friction material 25. It is understood that the coefficient of friction for the interface could be modified to at least some degree by modifying factors other than the glide sheet 20. For example, a high-friction substance or surface treatment may be applied to the bottom surface 44 of the pad 40, to increase the coefficient of friction of the interface. Examples of comparisons of the coefficients of friction for these surfaces and interfaces are shown in U.S. patent application Ser. Nos. 13/014,497 and 13/014,500, filed Jan. 26, 2011, which are incorporated by reference herein and made part hereof in their entireties.

Figure 15:
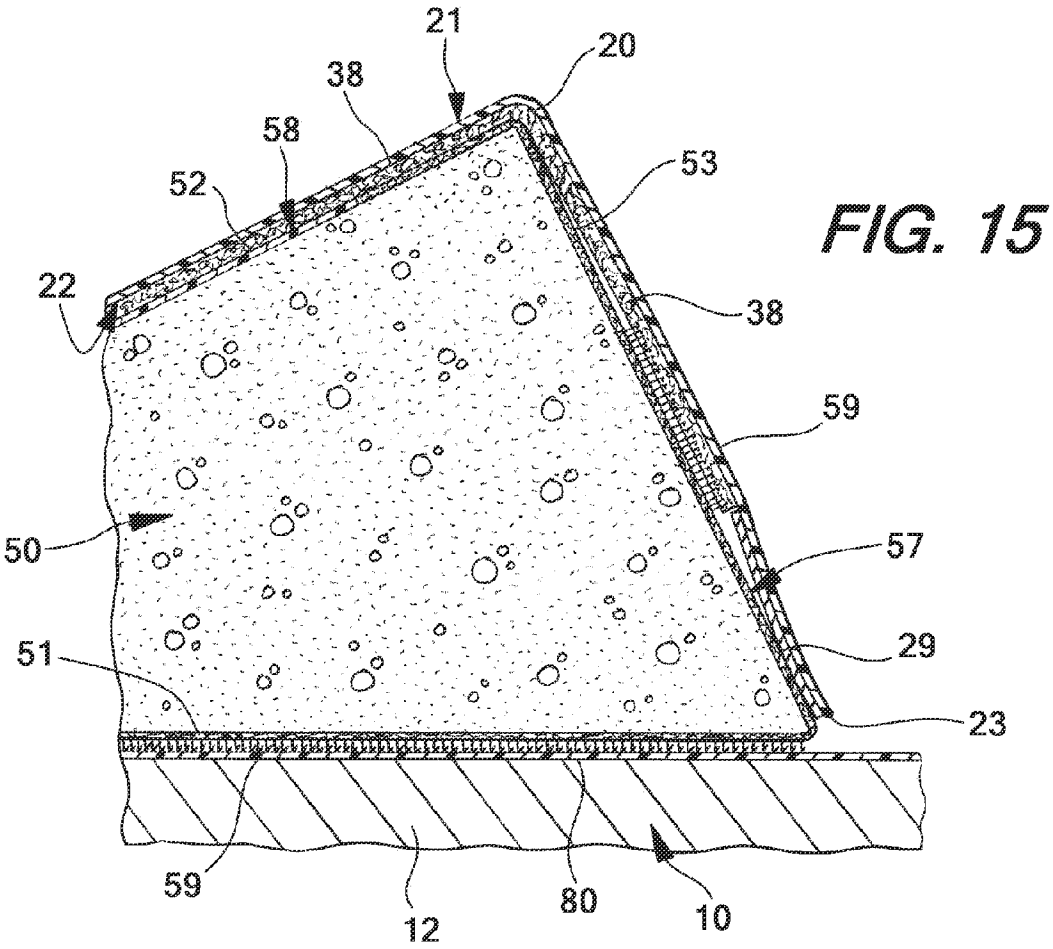

As shown in FIGS. 6 and 15, the glide sheet 20 also has a plurality of pieces of connecting material 38 on the bottom surface 22. In this embodiment, the pieces of connecting material 38 are in the form of rectangular patches 38 formed by a plurality of strips positioned in a row, and may be connected to the bottom surface 22 of the glide sheet 20 by stitching or another technique. The function of the pieces of connecting material 38 is described in greater detail below. In another embodiment, the bottom surface 22 may include pieces of connecting material 38 that are different in number, size, configuration, location, etc., or may contain no pieces of connecting material 38.

In the embodiment of FIGS. 1-6, the glide sheet 20 also includes a connecting member in the form of an elongated tether strap 30 connected to the glide sheet 20 and extending from the glide sheet 20 to connect to the base sheet 80 to secure the glide sheet 20 in place. As shown in FIGS. 4-5, the tether strap 30 is connected to the top edge 23 of the glide sheet 20 and extends to connect the strap 30 to the top edge 83 of the base sheet 80, such as by connection to the tether strap 90 of the base sheet 80. The tether strap 90 of the base sheet 80 may be connectable to the strap 30 of the glide sheet 20 by a releasable connecting structure, such as a hook-and-loop connection (e.g. Velcro). In the embodiment illustrated in FIGS. 1-6, the strap 30 of the glide sheet 20 has a piece of hook-type connecting material 32, and the strap 90 of the base sheet 80 is formed wholly or partially of a material that can function as a loop-type connecting material, allowing for connection of the two straps 30, 90. In another embodiment, the strap 30 may be connected to the tether strap 90 or other part of the base sheet 80 by a different configuration, including ties, snaps, buckles, adhesives, or other releasable or non-releasable fastener configurations. As described above, in a further embodiment, one or both of the glide sheet 20 and the base sheet 80 may include a different type of connecting member other than a tether strap 30, 90, such as a patch of releasable connecting material connected directly to the sheet 20, 80.

The strap 30 may be made from a single piece or multiple pieces. In the embodiment of FIGS. 1-6, the strap 30 is formed from an elastic material that is flexible and stretchable, such as a variable force elastic material that allows initial stretching for a distance (e.g. 2-3 inches) and then provides increased resistance to stretching. Once connected to the bed 12, the strap 30 resists or prevents the sheet 20 from sliding downward, particularly when the head 13 of the bed 12 is inclined. The elastic material provides for slight freedom of movement in this situation, and in one embodiment, allows for approximately 2-3 inches of stretching and 2-3 inches of resultant movement of the glide sheet 20. The tether strap 90 of the base sheet 80 provides a secure anchor for the glide sheet 20, as the base sheet 80 is securely strapped to the bed 12 using the fasteners 84. The two fasteners 84 having ends 84A proximate the tether strap 90 provide secure support for the tether strap 90, to resist movement or tearing of the base sheet 80 that may occur due to forces exerted by the strap 90 after connection to the glide sheet 20. Further, the releasable connection between the strap 30 of the glide sheet 20 and the strap 90 of the base sheet 80 permits easier disconnection of the straps 30, 90, such as for circumstances in which it is necessary to disconnect the strap 30 to move or reposition the patient. In other embodiments, the strap 30 may contain multiple pieces, such as an elastic portion and a non-elastic portion, and may have a different configuration or be connected to a different part of the glide sheet 20. In a further embodiment, the glide sheet 20 may have multiple tether straps 30 connected thereto, which can provide more secure connection to the base sheet 80 and/or greater options for connection.

The glide sheet 20 may also include one or more handles 28 to facilitate pulling, lifting, and moving the glide sheet 20. As shown in FIG. 6, the glide sheet 20 has handles 28 formed by strips 29 of a strong material that are stitched in periodic fashion to the bottom surface 22 at or around opposite edges 23 of the glide sheet 20. The non-stitched portions can be separated slightly from the glide sheet 20 to allow a user's hands to slip underneath, and thereby form the handles 28, as shown in FIG. 6. Other types of handles may be utilized in other embodiments.

In further embodiments, the glide sheet 20 and the components thereof may have different configurations, such as being made of different materials or having different shapes and relative sizes. For example, in one embodiment, the low-friction material 25 and the high-friction material 24 may be made out of pieces of the same size. In another embodiment, the low-friction material 25 and the high-friction material 24 may be part of a single piece that has a portion that is processed or treated to create a surface with a different coefficient of friction. As an example, a single sheet of material could be treated with a non-stick coating or other low-friction coating or surface treatment on one side, and/or an adhesive or other high-friction coating or surface treatment on the other side. Still other embodiments are contemplated within the scope of the invention.

In an alternate embodiment, the glide sheet 20 may not utilize a high friction surface, and instead may utilize a releasable connection to secure the pad 40 in place with respect to the glide sheet 20. For example, the glide sheet 20 and pad 40 may include complementary connections, such as hook-and-loop connectors, buttons, snaps, or other connectors. In another alternate embodiment, the glide sheet 20 may not utilize a strap 30, and may resist sliding in another way. In a further embodiment, the glide sheet 20 may be used without a pad 40, with the patient directly in contact with the top surface 21 of the sheet, and the high-friction material 24 can still resist sliding of the patient on the glide sheet 20.

Figure 9:
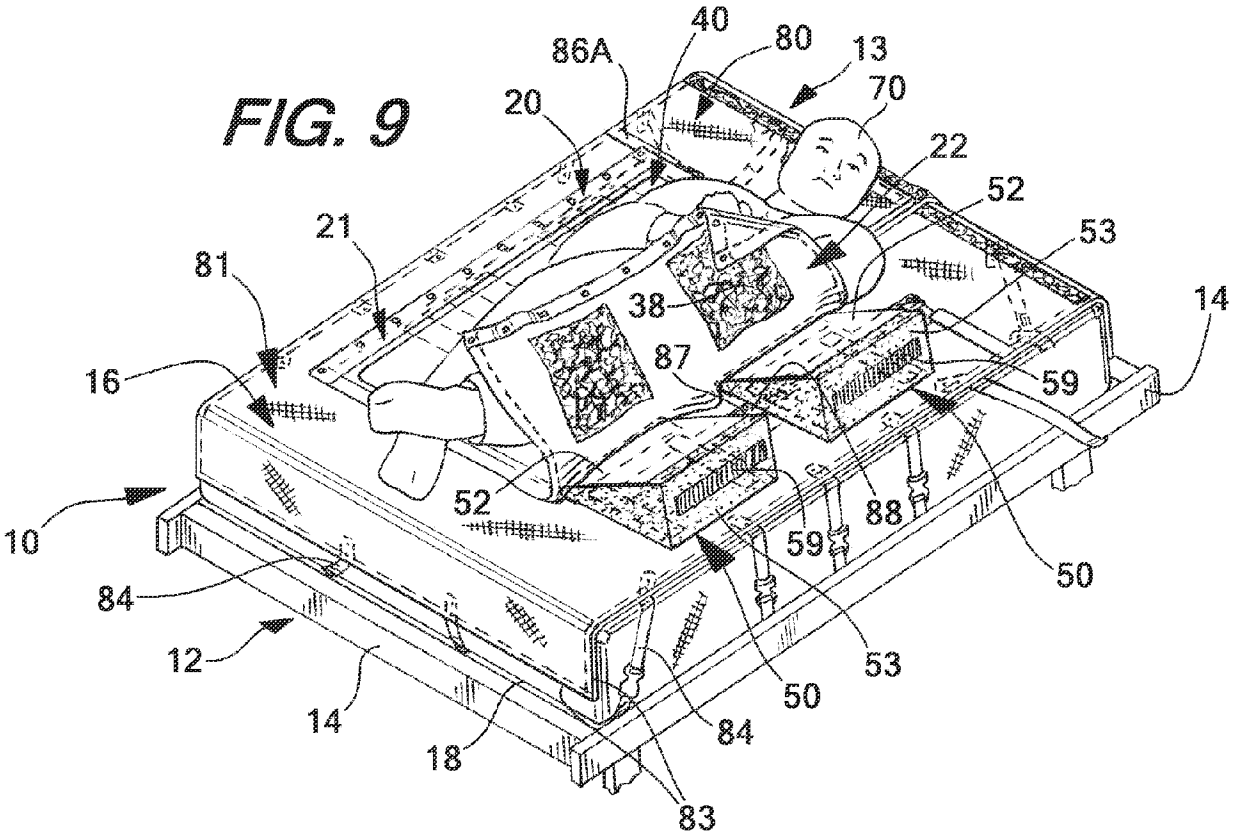
FIG. 9 is a perspective view of the system of FIG. 1 connected to a bed, with a patient lying on the bed, illustrating the insertion of two wedges to support the patient.
Figure 10:
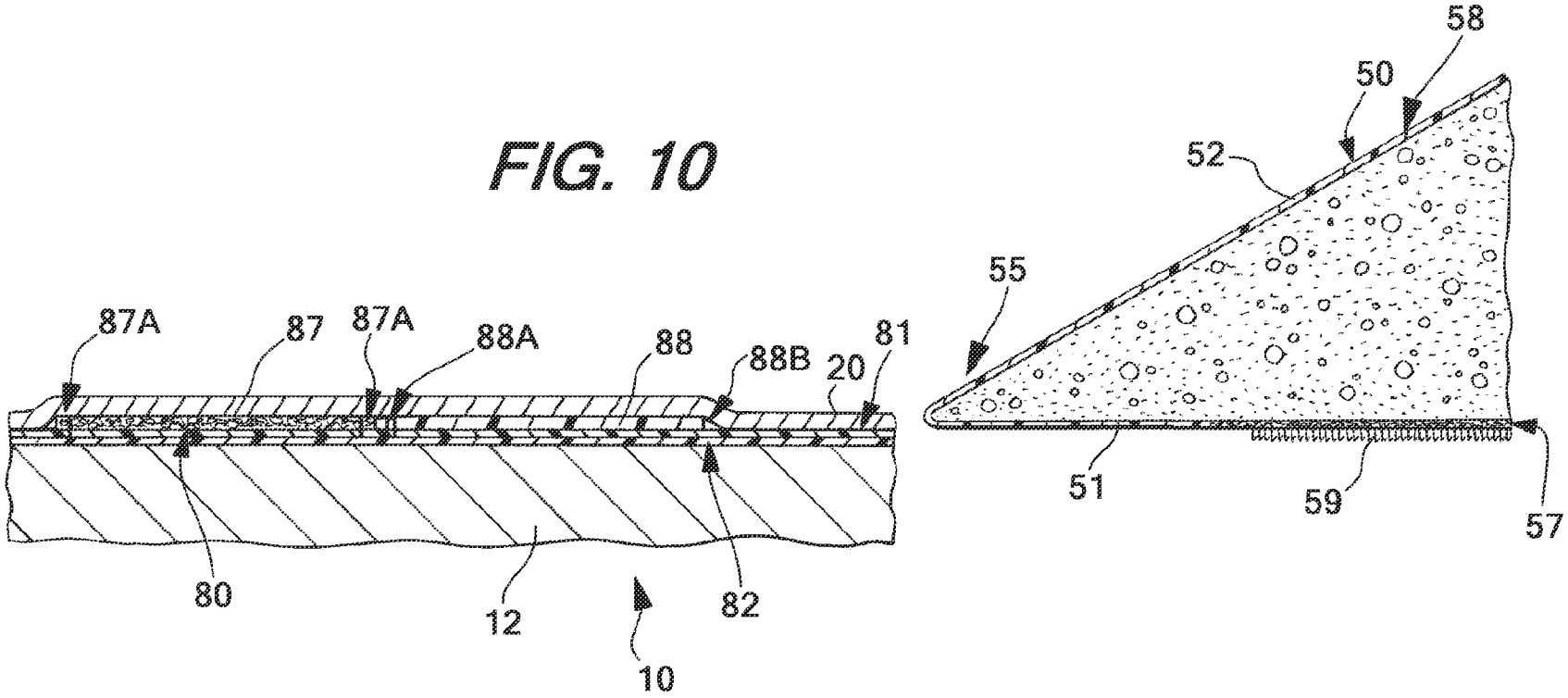
FIGS. 10-15 are a chronological series of cross-sectional views, illustrating placement of a wedge between the base sheet and the glide sheet of FIG. 9.
Figure 11:
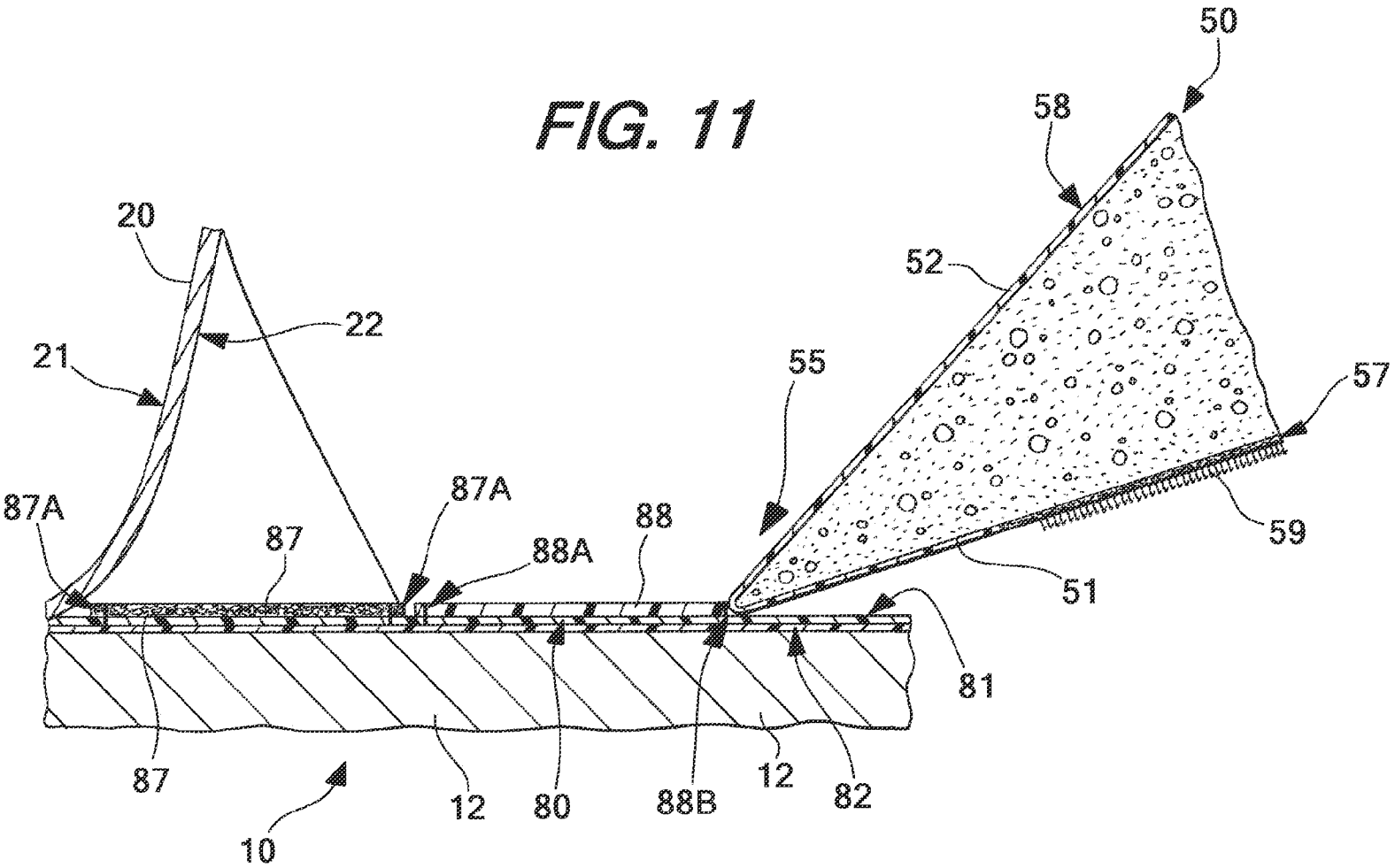
Figure 12:
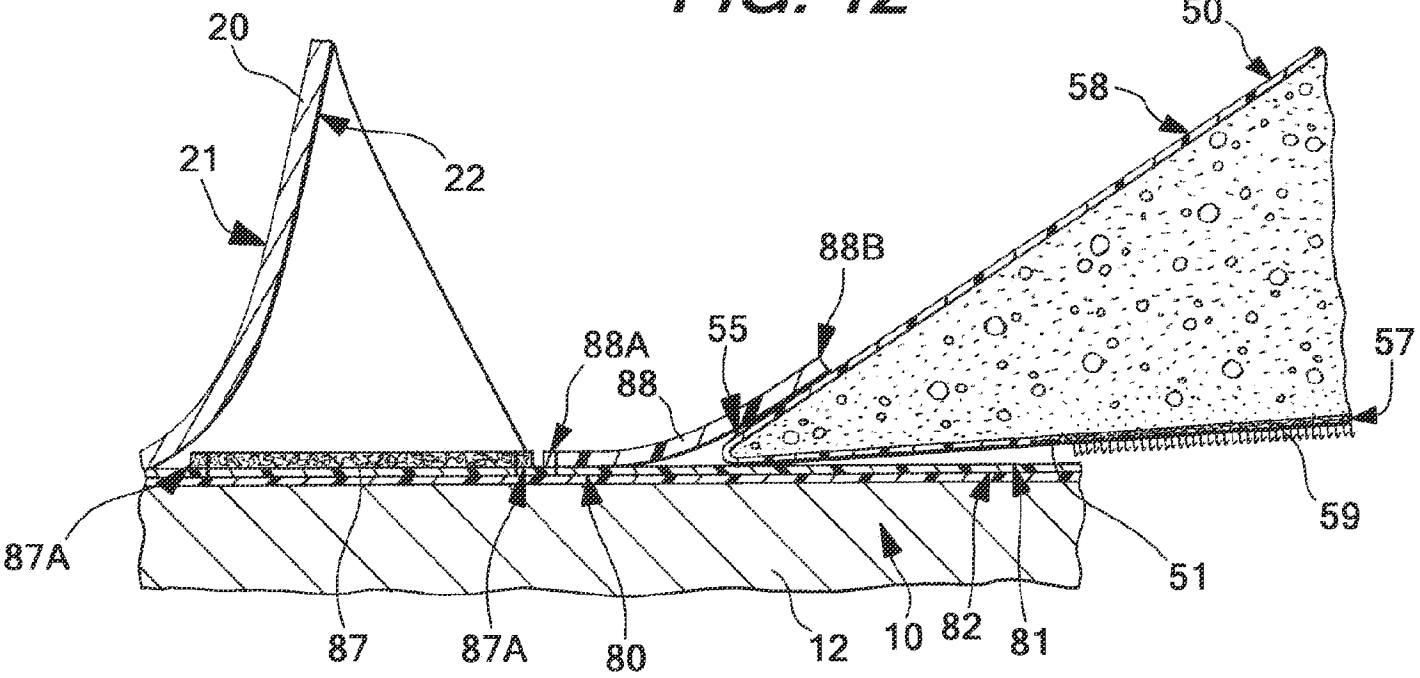
Figure 13:
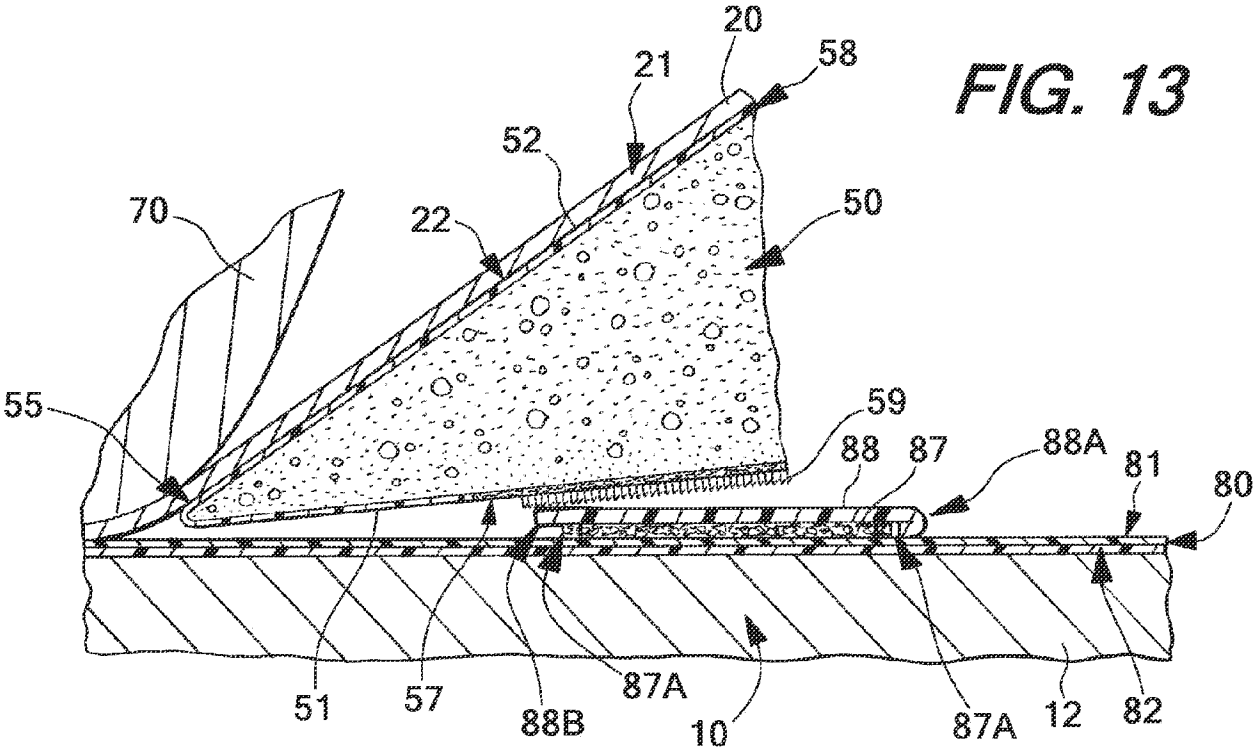

The body pad 40 is typically made from a different material than the glide sheet 20 and the base sheet 80 and contains an absorbent material, along with possibly other materials as well. The pad 40 provides a resting surface for the patient, and can absorb fluids that may be generated by the patient. The pad 40 may also be a low-lint pad, for less risk of wound contamination, and is typically disposable and replaceable, such as when soiled. The top and bottom surfaces 42, 44 may have the same or different coefficients of friction. Additionally, the pad 40 illustrated in the embodiments of FIGS. 1, 9, and 16 is approximately the same size as the glide sheet 20, but may be a different size in other embodiments. It is understood that the body pad 40 may not be illustrated in all drawing figures for the sake of simplicity and illustration, such as in FIGS. 4 and 10-15, and this should not be interpreted as an indication that the body pad 40 would or should not be present in such illustrated configurations.

In one embodiment, the pad 40 may form an effective barrier to fluid passage on one side, in order to prevent the glide sheet 20 and the base sheet 80 from being soiled, and may also be breathable, in order to permit flow of air, heat, and moisture vapor away from the patient and lessen the risk of pressure ulcers (bed sores). The glide sheet 20 and/or the base sheet 80 may also be breathable to perform the same function, as described above. A breathable glide sheet 20 and base sheet 80, used in conjunction with a breathable pad 40, can also benefit from use with a LAL bed 12, to allow air, heat, and moisture vapor to flow away from the patient more effectively, and to enable creation of an optimal microclimate around the patient, as described in U.S. patent application Ser. Nos. 13/014,497 and 13/014,500. The pad 40 may have differently configured top and bottom surfaces 42, 44, with the top surface 42 being configured for contact with the patient and the bottom surface 44 being configured for contact with the glide sheet 20.

Figure 7:
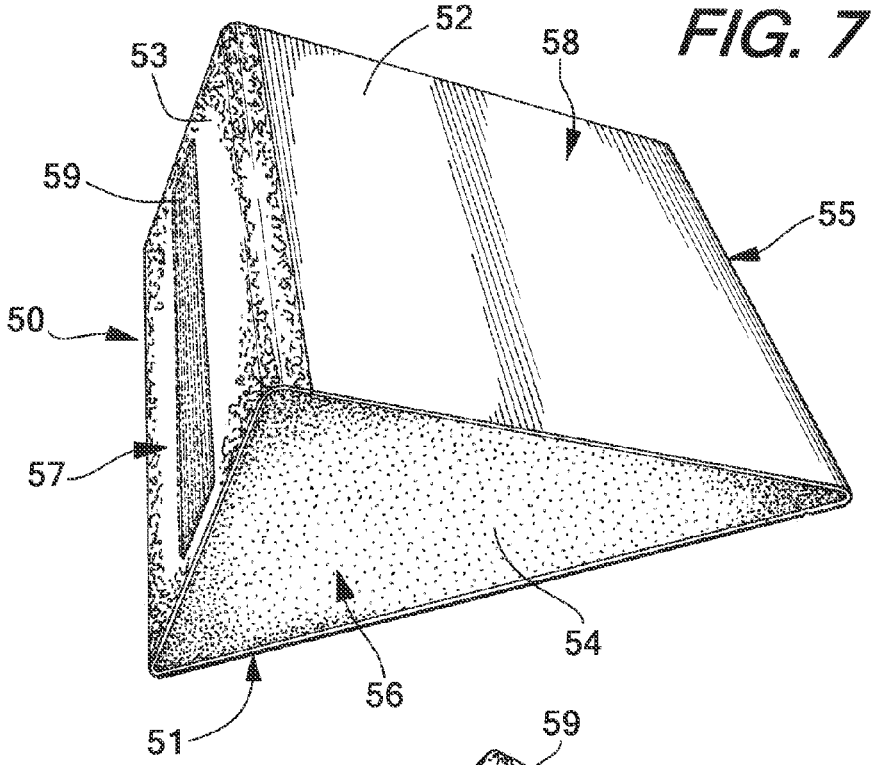
FIG. 7 is a perspective view of the wedge of FIG. 1.
Figure 8:
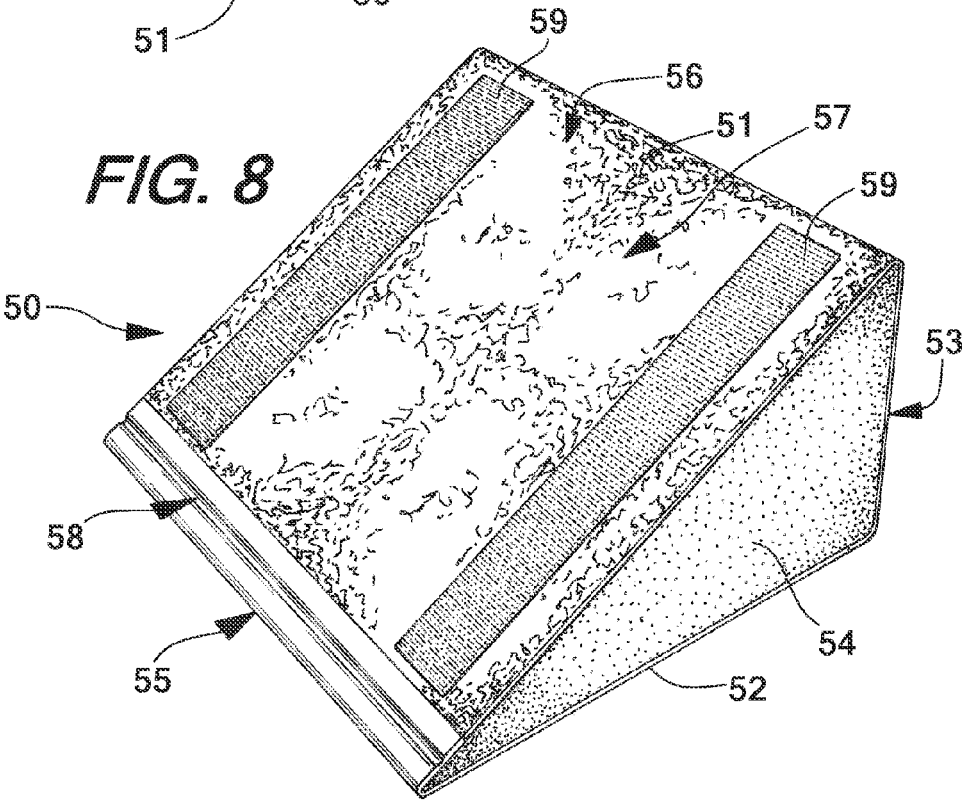
FIG. 8 is a bottom perspective view of the wedge of FIG. 7.

The system 10 may include one or more wedges 50 that can be positioned under the glide sheet 20 to provide a ramp and support to slide and position the patient slightly on his/her side, as described below. FIGS. 7-8 illustrate an example embodiment of a wedge 50 that can be used in conjunction with the system 10. The wedge 50 has a body 56 that can be triangular in shape, having a base wall or base surface 51, a ramp surface 52 that is positioned at an oblique angle to the base wall 51, a back wall 53, and side walls 54. In this embodiment, the base wall 51 and the ramp surface 52 meet at an oblique angle to form an apex 55, and the back wall 53 is positioned opposite the apex 55 and approximately perpendicular to the ramp surface 52. The side walls 54 in this embodiment are triangular in shape and join at approximately perpendicular angles to the base wall 51, the ramp surface 52, and the back wall 53. In this embodiment, the surfaces 51, 52, 53, 54 of the wedge body 56 are all approximately planar when not subjected to stress, but in other embodiments, one or more of the surfaces 51, 52, 53, 54 may be curved or rounded. Any of the edges between the surfaces 51, 52, 53, 54 of the wedge body 56 may likewise be curved or rounded, including the apex 55.

The wedge body 56 in this embodiment is at least somewhat compressible, in order to provide greater patient comfort and ease of use. Any appropriate compressible material may be used for the wedge body 56, including various polymer foam materials, such as a polyethylene and/or polyether foam. A particular compressible material may be selected for its specific firmness and/or compressibility, and in one embodiment, the wedge body 56 is made of a foam that has relatively uniform compressibility.

The wedge 50 is configured to be positioned under the glide sheet 20 and the patient, and between the glide sheet 20 and the base sheet 80, to position the patient at an angle, as described in greater detail below. In this position, the base wall 51 of the wedge 50 faces downward and engages or confronts the top surface 81 of the base sheet 80, and the ramp surface 52 faces toward the glide sheet 20 such that the wedge 50 supports at least a portion of the weight of the patient. The angle of the apex 55 between the base wall 51 and the ramp surface 52 influences the angle at which the patient is positioned when the wedge 50 is used. In one embodiment, the angle between the base wall 51 and the ramp surface 52 may be up to 45°, or between 15° and 35° in another embodiment, or about 30° in a further embodiment. Positioning a patient at an angle of approximately 30° is clinically recommended, and thus, a wedge 50 having an angle of approximately 30° may be the most effective for use in positioning most immobile patients. The wedge 50 may be constructed with a different angle as desired in other embodiments. It is understood that the glide sheet 20 and/or the base sheet 80 may be usable without the wedges 50, or with another type of wedge or other structure that can function as a wedge. For example, the glide sheet 20 and/or the base sheet 80 may be usable with a single wedge 50 having a greater length, or a number of smaller wedges 50, rather than two wedges 50, in one embodiment. As another example, two wedges 50 may be connected together by a narrow bridge section or similar structure in another embodiment. It is also understood that the wedge(s) 50 may have utility for positioning a patient independently and apart from the glide sheet 20, the base sheet 80, or other components of the system 10, and may be used in different positions and locations than those described and illustrated herein.

In the embodiment illustrated in FIGS. 1, 7-8, 9, 15 and 16, the wedge 50 has one or more pieces of connecting material 59, such as a hook-and-loop material, connected to the base wall 51 (e.g. by adhesive) and one or more additional pieces of connecting material 59 connected to the back wall 53. The base wall 51 in this embodiment has two pieces of connecting material 59 in the form of two strips 59 of complementary releasable connecting material (e.g. hook-and-loop) that are elongated and oriented to extend in a direction of elongation that extends from the apex 55 to the back wall 53. The back wall 53 has another strip 59 of complementary releasable connecting material. As described below, the pieces of connecting material 59 on the base wall 51 are complementary and configured for connection with the pieces of connecting material 87 on the top surface 81 of the base sheet 80. For example, where the connecting material 59 on the wedge 50 may be a hook-type structure of a hook-and-loop connecting material, as described above, and the connecting material 87 on the base sheet 80 may be a complementary loop-type structure. Likewise, the connecting material 59 on the back wall 53 of the wedge 50 is complementary and configured for connection with the pieces of connecting material 38 on the bottom surface 22 of the base sheet 20. Other types and configurations of connecting material 59 can be used in other embodiments, and in some embodiments, either or both of the base wall 51 and the back wall 53 may have no pieces of connecting material 59.

The wedge 50 in this embodiment also has a low-friction or sliding material 58 positioned on the ramp surface 52. The low-friction material 58 may be any material described above with respect to the sheet 20, and in one embodiment, the low-friction material 58 of the wedge 50 may be the same as the low-friction material 25 of the glide sheet 20. The material 58 is connected to the wedge body 56 using an adhesive in the embodiment shown in FIGS. 7-8, and other connection techniques can be used in other embodiments. In this embodiment, the wedge 50 may also include a high-friction material 57 on the base wall 51 to resist sliding of the wedge 50 along the supporting surface 16 of the bed 12 once in position under the patient. The low-friction material 58 eases insertion of the wedge under the glide sheet 20 and the patient, and over the base sheet 80, and eases movement of the patient up the ramp surface 52 as described below. As shown in FIGS. 7-8, the low-friction material 58 is wrapped partially around the apex 55 in this embodiment, in order to ease insertion of the wedge 50 and resist separation or delamination of the material 58 from the wedge body 56 upon inserting the wedge 50. In another embodiment, the wedge(s) 50 may not contain the low-friction material 58 and may or may not include the high-friction material 57.

All or some of the components of the system 10 can be provided in a kit, which may be in a pre-packaged arrangement. For example, the glide sheet 20 and the pad 40 may be provided in a pre-folded arrangement or assembly, such that the pre-folded glide sheet 20 and pad 40 can then be unfolded together on the bed 12. The base sheet 80 may also be folded together or separately with the glide sheet 20 and the pad 40. Additionally, the base sheet 80, the glide sheet 20, the pad 40, and the wedges 50 may be packaged together by wrapping with a packaging material to form a package. It is understood that certain components may be separately wrapped even within a single package, such as the wedges. Various wrapping configurations that may be used in connection with the system 10, as well as methods for unfolding or otherwise unpackaging the packaged system 10, are illustrated in U.S. patent application Ser. Nos. 13/014,497 and 13/014,500. Further, the base sheet 80 may be configured so that the flaps 88 at least partially cover the strips of connecting material 87 when packaged. For example, the flaps 88 may be temporarily and/or weakly bound to the connecting material 87, such as by thin, easily frangible threads or small dots of releasable adhesive. This permits the base sheet 80 to be more easily configured for use immediately after unwrapping. Still further, multiple types of kits can be provided, with different sizes of glide sheets 20 and/or pads 40 for use with different bed sizes. For example, in one embodiment, a narrower glide sheet 20 may be provided for use with beds 12 that are closer to 40 inches wide, and a wider glide sheet 20 may be provided for use with beds 12 that are closer to 50 inches wide.

Exemplary embodiments of methods for utilizing the system 10 in connection with a patient 70 are illustrated in FIGS. 9-16. In one embodiment, the base sheet 80 can be placed on the bed 12 before the patient is placed on the bed 12. The base sheet 80 is positioned with the bottom side 82 engaging and/or confronting the supporting surface 16 of the bed 12, with the tether strap 90 at the head 13 of the bed 12. The positioning marker 86B may assist with placing the base sheet 80 on the bed 12, to indicate approximately where the base sheet 80 should be aligned with the head 13 of the bed 12. Additionally, the base sheet 80 should be positioned so that the strips of connecting material 87 are approximately centered across the width of the bed 12. The fasteners 84 can then be used to connect the base sheet 80 securely to the bed 12, which may include wrapping some of the fasteners 84 around portions of the frame 14 and/or mattress 18, and which may also include fastening complementary buckles 85 together.

After the base sheet 80 is in position, the glide sheet 20 (and optionally the pad 40 as well) can be placed over the base sheet 80, such that the bottom surface 22 of the glide sheet 20 engages or confronts the top surface 81 of the base sheet 80. The glide sheet 20 and the pad 40 can be inserted on top of the base sheet 80 before placing the patient 70 on the bed 12. Alternately, the glide sheet 20 and the pad 40 may be inserted underneath the patient 70 after placing the patient 70 on the bed 12, using a method similar to those described in U.S. patent application Ser. Nos. 13/014,497 and 13/014,500. For example, the patient 70 can be rolled to one side to permit one half of the glide sheet 20 and/or the pad 40 to be unfolded, and then the patient 70 can be rolled to the other side to permit the other half of the glide sheet 20 and/or the pad 40 to be unfolded, whereupon the patient 70 can be rolled back to his/her back. The positioning markers 86A indicate where the top peripheral edge 23 of the glide sheet 20 should be aligned when the glide sheet 20 is placed on top of the base sheet 80, as described below. The tether straps 30, 90 of the glide sheet 20 and the base sheet 80 can be connected together after the glide sheet 20 is placed on top of the base sheet 80. This connection helps to resist unwanted slipping of the glide sheet 20 on the base sheet 80, particularly downward slipping caused by raising the head 13 of the bed 12. The elasticity of the strap 30 of the glide sheet 20 permits some degree of movement freedom, in this embodiment. If the head 13 of the bed 12 is desired to be raised, then the straps 30, 90 can be connected after raising the head 13 of the bed 12, to allow for proper positioning of the patient before connecting the straps 30, 90. In another embodiment, the straps 30, 90 can be connected before raising the head 13 of the bed 12. The patient 70 may be moved slightly to ensure proper positioning before connecting the straps 30, 90, such as moving the patient 70 upward or toward the head of the bed 12, which can be accomplished by sliding the sheet 20 using the handles 28. The method illustrated in FIGS. 9-16 typically requires two or more caregivers for performance, but is less physically stressful and time consuming for the caregivers than existing methods.

The pad 40 can also be removed and replaced from underneath the patient using methods similar to those described in U.S. patent application Ser. Nos. 13/014,497 and 13/014,500. For example, the patient can be rolled to one side to permit one half of the pad 40 to be folded up, and then the patient can be rolled to the other side to permit the other half of the pad 40 to be folded up, whereupon the pad 40 can be removed and replaced with a different pad 40. The new pad 40 can be partially unfolded while the patient is still rolled to the second side, and then the patient can be rolled back to the first side to permit the other half of the new pad 40 to be unfolded. It is understood that other methods for placing the base sheet 80, the glide sheet 20, and/or the pad 40 on the bed 12 can be used in other embodiments.

FIGS. 9-16 illustrate an example embodiment of a method for placing the patient in an angled resting position by placing two wedges 50 under the patient 70. The method is used with a patient 70 lying on a bed 12 as described above, having a bed sheet (not shown) on the supporting surface 16 and the base sheet 80 on top of the bed sheet, with the glide sheet 20 and the pad 40 of the system 10 lying on top of the base sheet 80 and the patient 70 lying on the pad 40. In this embodiment, the wedges 50 are positioned under the glide sheet 20, so that the glide sheet 20 is between the ramp surfaces 52 of the wedges 50 and the patient 70, and the base walls 51 of the wedges 50 are in contact with the base sheet 80. In another embodiment, the wedges 50 may be positioned directly under the base sheet 80 and over the bed sheet 15, or underneath the bed sheet 15. As shown in FIGS. 9-13, the edge 23 of the glide sheet 20 is lifted, and the wedges 50 are inserted from the side of the bed 12 and from the left/right peripheral edge 83 of the base sheet 80, between the glide sheet 20 and the base sheet 80, and toward the flap 88 and toward the patient 70. At this point, a portion of the wedge 50, such as the apex 55, may engage the flap 88 and force the flap 88 to be flipped over to cover the connecting material 87, if the flap 88 is not already covering the connecting material 87. As described above, in one embodiment, the flap 88 completely covers the connecting material 87. The wedge 50 can be moved farther toward the patient 70 so that at least the apex 55 of the wedge 50 may be pushed toward, next to, or at least partially under the patient 70. The low friction material 58 of the wedge 50 can facilitate such insertion. A second wedge 50 can also be inserted from the same side of the bed 12 and the same peripheral edge 83 of the base sheet 80 in a similar manner. In one embodiment, the wedges 50 should be aligned so that the wedges are spaced apart with one wedge 50 positioned at the upper body of the patient 70 and the other wedge 50 positioned at the lower body of the patient 70, with the patient's sacral area positioned in the space between the wedges 50. It has been shown that positioning the wedges 50 in this arrangement can result in lower pressure in the sacral area, which can reduce the occurrence of pressure ulcers in the patient 70. In one embodiment, the wedges 50 are positioned approximately 10 cm apart.

Figure 14:
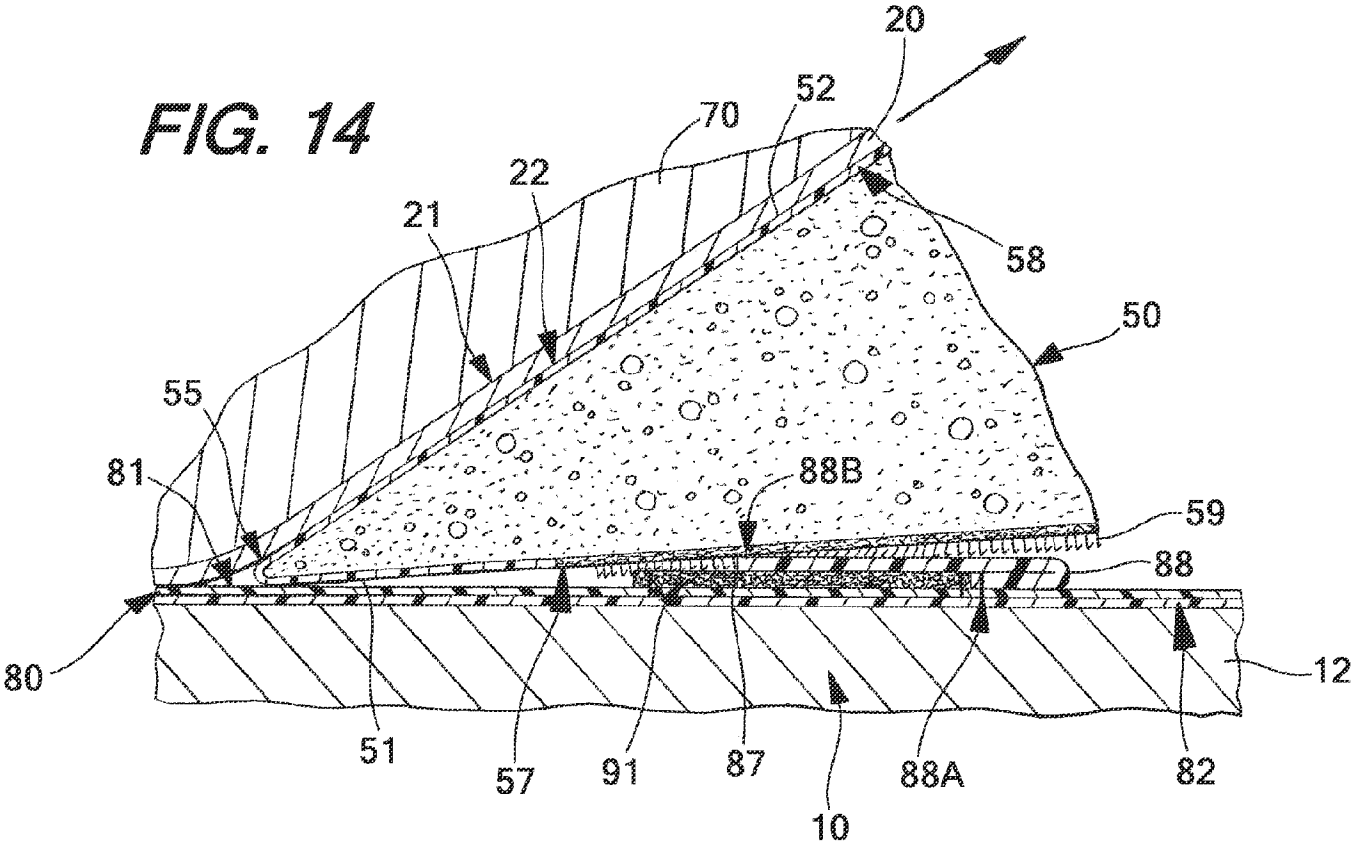

Once the wedges 50 have been inserted, the user (not shown), such as a caregiver, can pull the patient 70 toward the wedge 70 and toward the user, such as by gripping the handles 28 on the glide sheet 20, as similarly described in U.S. patent application Ser. Nos. 13/014,497 and 13/014,500. The arrows in FIG. 14 illustrate this movement. This moves the proximate edge 23 of the glide sheet 20 toward the back walls 53 of the wedges 50, toward the adjacent peripheral edge 83 of the base sheet 80, and toward the user, and slides the patient 70 and at least a portion of the glide sheet 20 up the ramp surface 52, such that the ramp surface 52 partially supports the patient 70 to cause the patient 70 to lie in an angled position. During this pulling motion, the low friction materials 25, 58 on the glide sheet 20 and the wedges 50, as well as the low friction material of the base sheet 80, provide ease of motion, and the high friction surface 24 of the glide sheet 20 resists movement of the pad 40 and/or the patient 70 with respect to the sheet 20. Additionally, the elastic portion 32 of the strap 30 permits some freedom of movement of the glide sheet 20.

When the glide sheet 20 is pulled toward the user, the wedges 50 may be forced backward, toward the adjacent peripheral edge 83 of the base sheet 80. Due to this motion, the flap 88 may be forced backward to expose at least a portion 91 of the connecting material 87. It is understood that the exposed portion 91 may constitute all or substantially all of the connecting material 87 in some circumstances, and additionally, in a situation where the flap 88 does not initially cover the connecting material 87 completely, that the exposed portion 91 may be a portion that was not previously exposed. As described above, the engagement between the reinforcing material 89 of the flap 88 and the base wall 51 and/or the connecting material 59 of the wedge 50 can assist in moving the flap 88 in this manner. The connecting material 59 on the base wall 51 of the wedge 50 then engages the exposed portion 91 of the connecting material 87 on the base sheet 80 to resist further movement of the wedge 50 toward the adjacent peripheral edge 83 of the base sheet 80. This resistance to further movement 50 can assist in keeping the wedge(s) 50 in position and in stabilizing the patient 70, and may be further supported by the high friction material 57 that may be connected to the base wall 51 of the wedge 50. Advantageously, the placement of the wedges 50 and the movement of the patient 70 onto the wedges 50 may be done without rolling the patient 70 onto his/her side in some embodiments. This can provide particular advantage with large patients, who may be more difficult to move and roll. It is understood that the glide sheet 20 may be pulled slightly away from the edge of the bed 12 prior to insertion of the wedges 50, in order to provide room for insertion, such as by pulling on the handles 28 on the opposite side of the glide sheet 20. In another embodiment, the patient 70 may be rolled to his/her side for at least some of this positioning, such as described in U.S. patent application Ser. Nos. 13/014,497 and 13/014,500. Additionally, part of the glide sheet 20 can be wrapped or draped over the top of the wedge 50 so that the connecting material 38 on the bottom surface 22 of the glide sheet 20 is connected to the connecting material 59 on the back wall 53 of the wedge 50. This can assist in securing the glide sheet 20 against slipping downward, keeping the wedges 50 securely positioned underneath the patient 70.

When the patient 70 is to be returned to lying on his/her back, the wedge(s) 50 can be removed from under the patient 70, which may include pulling the wedge(s) 50 so that the connecting materials 59 of the wedge 50 become disconnected from the connecting material 38 of the glide sheet 20 and the connecting material 87 of the base sheet 80. The sheet 20 may be pulled in the opposite direction in order to facilitate removal of the wedges 50 and/or position the patient 70 closer to the center of the bed 12. The patient can be turned in the opposite direction by inserting the wedges 50 under the opposite side of the glide sheet 20, from the opposite peripheral edge 83 of the base sheet 80, and pulling the glide sheet 20 in the opposite direction to move the patient 70 up the ramp surfaces 52 of the wedges 50, in the same manner described above.

As described above, in some embodiments, the wedges 50 may have an angle of up to approximately 45°, or from approximately 15-35°, or approximately 30°. Thus, when these embodiments of wedges 50 are used in connection with the method as shown in FIGS. 9-16, the patient 70 need not be rotated or angled more than 45°, 35°, or 30°, depending on the wedge 50 configuration. The degree of rotation can be determined by the rotation or angle from the horizontal (supine) position of a line extending through the shoulders of the patient 70. Existing methods of turning and positioning patients to relieve sacral pressure often require rolling a patient to 90° or more to insert pillows or other supporting devices underneath. Rolling patients to these great angles can cause stress and destabilize some patients, particularly in patients with critical illnesses or injuries, and some critical patients cannot be rolled to such great angles, making turning of the patient difficult. Additionally, large patients can be even more difficult to turn, causing additional strain and risk of injury for caregivers. Accordingly, the system 10 and method described above can have a positive effect on the health and comfort of both patients and caregivers. Further, the angled nature of the wedges 50 can allow for more accurate positioning of the patient 70 to a given resting angle, as compared to existing, imprecise techniques such as using pillows for support. For example, the recommended resting angle of 30° can be more successfully achieved with a wedge 50 that has an angle of approximately 30°. The engagement of the connecting materials 59 of the wedge 50 with the connecting materials 87, 38 of the base sheet 80 and the glide sheet 20 resists sliding of the wedge 50 and the glide sheet 20, and aids in maintaining the same turning angle. Pillows, as currently used, provide inconsistent support and can slip out from underneath a patient more easily.

In various other embodiments, certain components and features of the system 10 can be added, duplicated, and/or changed to a different size or location, including transposing a feature to be located on a different component. For example, the connecting materials 38, 59, 87 may be illustrated and described as being hook-type or loop-type connecting materials 38, 59, 87, but any pair of complementary hook or loop-type materials can be transposed. In one embodiment, the wedge 50 may have one or more pieces of loop-type connecting material 59 thereon, and the base sheet 80 and/or the glide sheet 20 may have hook-type connecting materials 38, 87. As another example, the flaps 88 may be relocated from the top surface 81 of the base sheet 80 to the base wall 51 of the wedge 50 in one embodiment. In this configuration, the flaps 88 may still be able to fulfill the function of at least partially separating the connecting materials 59, 87 of the wedge 50 and the base sheet 80. As a further example, the configurations of the tether straps 30, 90 of the glide sheet 20 and the base sheet 80 may be transposed. Still other examples exist and are recognizable to those skilled in the art.

The use of the system 10 and methods described above can result in a significantly decreased number of pressure ulcers in patients. The system 10 reduces pressure ulcers in a variety of manners, including reducing pressure on sensitive areas, reducing shearing and friction on the patient's skin, and managing heat and moisture at the patient's skin. The system 10 can reduce pressure on the patient's skin by facilitating frequent turning of the patient and providing consistent support for accurate resting angles for the patient upon turning. The system 10 can reduce friction and shearing on the patient's skin by resisting sliding of the patient along the bed 12, including resisting sliding of the patient downward after the head 13 of the bed 12 is inclined, as well as by permitting the patient to be moved by sliding the sheet 20 against the bed 12 instead of sliding the patient. The system 10 can provide effective heat and moisture management for the patient by the use of the absorbent body pad. The breathable properties of the sheet 20 and pad 40, are particularly beneficial when used in conjunction with an LAL bed system. When used properly, pressure ulcers can be further reduced or eliminated.

The use of the system 10 and methods described above can also have beneficial effects for nurses or other caregivers who turn and position patients. Such caregivers frequently report injuries to the hands, wrists, shoulders, back, and other areas that are incurred due to the weight of patients they are moving. This problem can be particularly pervasive in the case of large patients. Use of the system 10, including the glide sheet 20, the base sheet 80, and the wedges 50, can reduce the strain on caregivers when turning and positioning patients. For example, existing methods for turning and positioning a patient 70, such as methods including the use of a folded-up bed sheet for moving the patient 70, typically utilize lifting and rolling to move the patient 70, rather than sliding. Protocols for these existing techniques encourage lifting to move the patient and actively discourage sliding the patient, as sliding the patient 70 using existing systems and apparatuses can cause friction and shearing on the patient's skin. The ease of motion and reduction in shearing and friction forces on the patient 70 provided by the system 10 allows sliding of the patient 70, which greatly reduces stress and fatigue on caregivers. In one embodiment, the system 10 can be used with patients up to 400 lbs. and also patients that exceed 400 lbs. in weight.

As another example, the act of pulling and sliding the sheet 20 and patient 70 toward the caregiver to turn the patient 70 to an angled position creates an ergonomically favorable position for movement, which does not put excessive stress on the caregiver. In particular, the caregiver does not need to lift the patient 70 at all, and may turn the patient 70 simply by pulling on the handles 28 to allow the mechanical advantage of the ramp surface 52 to turn the patient 70. Additionally, it allows the patient 70 to be turned between the angled and non-angled positions (e.g.)30°-0°-30° by only a single caregiver. Prior methods often require two or more caregivers. Caregivers may also comply more closely with Q2 turning protocols when using the glide sheet 20, the base sheet 80, and wedges 50 as described above and shown in FIGS. 9-16.

As further examples, the low friction material 25 on the bottom surface 22 of the glide sheet 20, alone or in combination with the low friction material of the base sheet 80, facilitates all movement of the patient 70 on the bed 12. Additionally, the high friction material 24 on the sheet 20 reduces movement of the patient 70 and the use of the tether straps 30, 90 reduces or eliminates sliding of the patient 70 when the bed is inclined, thereby reducing the necessity for the caregiver to reposition the patient 70. Further, the engagement of the connecting materials 59 of the wedge 50 with the connecting material 38 of the glide sheet 20 and the connecting material 87 of the base sheet 80 help keep the wedges 50 and the patient 70 in position once the patient 70 has been turned. Still other benefits and advantages over existing technology are provided by the system 10 and methods described herein, and those skilled in the art will recognize such benefits and advantages.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A system for use with a bed having a frame and a supporting surface supported by the frame, the system comprising:

a base sheet having a bottom surface adapted to be placed above the supporting surface of the bed and a top surface opposite the bottom surface, the top and bottom surfaces being defined by peripheral edges of the base sheet;

a glide sheet configured to be positioned above the top surface of the base sheet;

a first piece of releasable connecting material connected to a bottom surface of the glide sheet;

a wedge comprising a base wall, a ramp surface, an apex formed by the base wall and the ramp surface, and a back wall opposite the apex, the ramp surface being positioned at an angle to the base wall, wherein the wedge is configured to be positioned between the base sheet and the glide sheet, such that the base wall confronts the top surface of the base sheet; and a second piece of releasable connecting material connected to the base-back wall of the wedge, wherein the releasable connecting materials of the first and second pieces are complementary, wherein the wedge and the glide sheet are configured such that, upon placement of the wedge such that the apex of the wedge is fully inserted between the base sheet and the glide sheet, a portion of the glide sheet including the first piece drapes over the back wall of the wedge, the second piece becomes connected to the first piece to resist movement of the wedge and the glide sheet relative to each other.

2. The system of claim 1, further comprising:

a third piece of releasable connectin material connected to the top surface ofthe base sheet and spaced inwardly from a first of the peripheral edges of the base sheet;

a fourth piece of releasable connecting material connected to the base wall of the wedge, wherein the releasable connecting materials of the third and fourth pieces are complementary;

a flap positioned proximate the third piece, the flap having a fixed end connected to the top surface of the base sheet, in an area located between the third piece and the first peripheral edge of the base sheet, and a free end opposite the fixed end, wherein the flap is foldable such that the free end can be folded over the third piece so that the flap covers at least a portion of the third piece, wherein upon placement of the wedge over the base sheet by sliding the wedge from the first peripheral edge of the base sheet, the apex of the wedge pushes the flap away from the first peripheral edge to cover the third piece, and wherein a subsequent force exerted on the wedge toward the first peripheral edge causes the flap to be pushed toward the first peripheral edge to expose at least a portion of the first third piece, causing the fourth piece to become connected to an exposed portion of the third piece to resist further movement of the wedge toward the first peripheral edge.

3. The system of claim 1, wherein the wedge comprises a body made from a compressible foam material defining the base wall, the ramp surface, the apex, and the back wall, wherein the second piece is connected to the body, and the wedge further comprises a low-friction material connected to the body and forming at least a portion of the ramp surface.

4. The system of claim 1, wherein the releasable connecting materials of the first and second pieces are hook-and-loop connecting materials, such that one of the first and second pieces is a hook-type material and another of the first and second pieces is a loop-type material.

5. The system of claim 1, further comprising:

a first connecting member connected to the base sheet; and a second connecting member connected to the glide sheet, wherein the first connecting member and the second connecting member have complementary connecting structures, such that the first connecting member is releasably connectable to the second connecting member to hold the glide sheet in position relative to the base sheet, and wherein at least one of the connecting members comprises a tether strap connected to and extending from one of the base sheet and the glide sheet.

6. The system of claim 5, wherein the first connecting member comprises a first tether strap connected to the base sheet and extending from the base sheet, and the second connecting member comprises a second tether strap connected to the glide sheet and extending from the glide sheet.

7. The system of claim 5, wherein the tether strap comprises an elastic portion forming at least a portion of a length thereof.

8. The system of claim 5, wherein the first connecting member and the second connecting member have complementary hook-and-loop connecting structures.

9. The system of claim 1, wherein the glide sheet has a bottom surface confronting the base sheet and a top surface opposite the bottom surface, wherein the bottom surface of the glide sheet has a low friction surface forming at least a portion of the bottom surface, and the top surface of the glide sheet has a high friction surface forming at least a portion of the top surface, such that the top surface of the glide sheet provides greater slipping resistance than the bottom surface of the glide sheet.

10. The system of claim 9, wherein the top surface of the base sheet has a low friction surface forming at least a portion of the top surface, wherein the low friction surface of the base sheet and the low friction surface of the glide sheet are formed by a same low friction material.

11. The system of claim 1, wherein the base sheet further comprises a plurality of fasteners located around the peripheral edges of the sheet, the fasteners configured to releasably fasten the sheet to the bed.

12. The system of claim 1, wherein the releasable connecting materials of the first piece and the second piece are hook-and-loop connecting materials.

13. The system of claim 1, further comprising:

a third piece of releasable connecting material connected to the top surface of the base sheet and spaced inwardly from a first of the peripheral edges of the base sheet;

a fourth piece of releasable connecting material connected to the base wall of the wedge, wherein the releasable connecting materials of the third and fourth pieces are complementary, wherein the wedge and the base sheet are configured such that, upon placement of the wedge over the base sheet proximate the first peripheral edge of the base sheet, the fourth piece becomes connected to the third piece to resist movement of the wedge toward the first peripheral edge.

14. A system for use with a bed having a frame and a supporting surface supported by the frame, the system comprising:

a base sheet having a bottom surface adapted to be placed above the supporting surface of the bed and a top surface opposite the bottom surface, the top and bottom surfaces being defined by peripheral edges of the base sheet, wherein the peripheral edges include opposite first and second side edges;

a first piece of a hook-and-loop connecting material connected to the top surface of the base sheet and spaced inwardly from the first side edge of the base sheet;

a second piece of a hook-and-loop connecting material connected to the top surface of the base sheet and spaced inwardly from the second side edge of the base sheet;

a first flap positioned proximate the first piece and a second flap positioned proximate the second piece, the first and second flaps each having a fixed end connected to the top surface of the base sheet and a free end opposite the fixed end, wherein the fixed end of the first flap is located in an area located between the first piece and the first peripheral edge of the base sheet, and the first flap is foldable such that the free end can be folded over the first piece so that the first flap covers at least a portion of the first piece, and wherein the fixed end of the second flap is located in an area located between the second piece and the second peripheral edge of the base sheet, and the second flap is foldable such that the free end can be folded over the second piece so that the second flap covers at least a portion of the second piece;

a wedge comprising a base wall, a ramp surface, an apex formed by the base wall and the ramp surface, and a back wall opposite the apex, the ramp surface being positioned at an angle to the base wall, wherein the wedge is configured to be positioned over the base sheet, such that the base wall confronts the top surface of the base sheet; and a third piece of hook-and-loop connecting material connected to the base wall of the wedge, wherein the hook-and-loop connecting materials of the first and second pieces are complementary to the hook-and-loop connecting material of the third piece, wherein upon placement of the wedge over the base sheet by sliding the wedge from the first peripheral edge of the base sheet, the apex of the wedge pushes the first flap away from the first peripheral edge to cover the first piece, and wherein a subsequent force exerted on the wedge toward the first peripheral edge causes the first flap to be pushed toward the first peripheral edge to expose at least a portion of the first piece, causing the third piece to become connected to an exposed portion of the first piece to resist further movement of the wedge toward the first peripheral edge, and wherein upon placement of the wedge over the base sheet by sliding the wedge from the second peripheral edge of the base sheet, the apex of the wedge pushes the second flap away from the second peripheral edge to cover the second piece, and wherein a subsequent force exerted on the wedge toward the second peripheral edge causes the second flap to be pushed toward the second peripheral edge to expose at least a portion of the second piece, causing the third piece to become connected to an exposed portion of the second piece to resist further movement of the wedge toward the second peripheral edge.

15. The system of claim 14, further comprising a glide sheet positioned above the top surface of the base sheet, wherein the wedge is configured to be placed between the base sheet and the glide sheet.

16. The system of claim 15, further comprising:

a fourth piece and a fifth piece of hook-and-loop connecting material connected to a bottom surface of the glide sheet; and a sixth piece of hook-and-loop connecting material connected to the back wall of the wedge, wherein the hook-and-loop connecting materials of the fourth and fifth pieces are complementary with the hook-and-loop connecting material of the sixth piece, wherein when the wedge and the glide sheet are configured such that when the apex of the wedge is fully inserted between the base sheet and the glide sheet by sliding the wedge between the base sheet and the glide sheet from the first peripheral edge of the base sheet, a first portion of the glide sheet including the fourth piece drapes over the back wall of the wedge and the fourth piece can be connected to the sixth piece to resist movement of the wedge and the glide sheet relative to each other, and wherein when the wedge and the glide sheet are configured such that when the apex of the wedge is fully inserted between the base sheet and the glide sheet by sliding the wedge between the base sheet and the glide sheet from the second peripheral edge of the base sheet, a second portion of the glide sheet including the fifth piece drapes over the back wall of the wedge and the fifth piece can be connected to the sixth piece to resist movement of the wedge and the glide sheet relative to each other.

17. The system of claim 14, further comprising:

a first connecting member connected to the base sheet; and a second connecting member connected to the glide sheet, wherein the first connecting member and the second connecting member have complementary connecting structures, such that the first connecting member is releasably connectable to the second connecting member to hold the glide sheet in position relative to the base sheet, and wherein at least one of the connecting members comprises a tether strap connected to and extending from one of the base sheet and the glide sheet.

18. The system of claim 17, wherein the glide sheet has a bottom surface confronting the base sheet and a top surface opposite the bottom surface, wherein the bottom surface of the glide sheet has a low friction surface forming at least a portion of the bottom surface, and the top surface of the glide sheet has a high friction surface forming at least a portion of the top surface, such that the top surface of the glide sheet provides greater slipping resistance than the bottom surface of the glide sheet.

19. The system of claim 18, wherein the top surface of the base sheet has a low friction surface forming at least a portion of the top surface, wherein the low friction surface of the base sheet and the low friction surface of the glide sheet are formed by a same low friction material.

20. A system for use with a bed having a frame and a supporting surface supported by the frame, the system comprising:

a base sheet having a bottom surface adapted to be placed above the supporting surface of the bed and a top surface opposite the bottom surface, the top and bottom surfaces being defined by peripheral edges of the base sheet;

a first piece of releasable connecting material connected to the top surface of the base sheet and spaced inwardly from a first of the peripheral edges of the base sheet;

a flap positioned proximate the first piece, the flap having a fixed end connected to the top surface of the base sheet, in an area located between the first piece and the first peripheral edge of the base sheet, and a free end opposite the fixed end, wherein the flap is foldable such that the free end can be folded over the first piece so that the flap covers at least a portion of the first piece;

a wedge comprising a base wall, a ramp surface, an apex formed by the base wall and the ramp surface, and a back wall opposite the apex, the ramp surface being positioned at an angle to the base wall, wherein the wedge is configured to be positioned over the base sheet, such that the base wall confronts the top surface of the base sheet; and a second piece of releasable connecting material connected to the base wall of the wedge, wherein the releasable connecting materials of the first and second pieces are complementary, wherein the wedge and the base sheet are configured such that, upon placement of the wedge over the base sheet proximate the first peripheral edge of the base sheet by sliding the wedge from the first peripheral edge, the apex of the wedge pushes the flap away from the first peripheral edge to cover the first piece, and wherein a subsequent force exerted on the wedge toward the first peripheral edge causes the flap to be pushed toward the first peripheral edge to expose at least a portion of the first piece, causing the second piece to become connected to an exposed portion of the first piece to resist further movement of the wedge toward the first peripheral edge.

21. The system of claim 20, wherein the releasable connecting materials of the first and second pieces are hook-and-loop connecting materials, such that one of the first and second pieces is a hook-type material and another of the first and second pieces is a loop-type material.

22. The system of claim 20, further comprising:

a third piece of releasable connecting material connected to the top surface of the base sheet and spaced inwardly from a second of the peripheral edges of the base sheet, opposite the first peripheral edge, wherein the releasable connecting material of the third piece is the same as the releasable connecting material of the first piece, such that the releasable connecting material of the second and third pieces are complementary, wherein the wedge and the base sheet are configured such that, upon placement of the wedge over the base sheet proximate the second peripheral edge of the base sheet, the second piece becomes connected to the third piece to resist movement of the wedge toward the second peripheral edge.

23. The system of claim 22, further comprising:

a second flap positioned proximate the third piece, the second flap having a fixed end connected to the top surface of the base sheet, in an area located between the third piece and the second peripheral edge of the base sheet, and a free end opposite the fixed end, wherein the second flap is foldable such that the free end can be folded over the third piece so that the flap covers at least a portion of the third piece, wherein upon placement of the wedge over the base sheet by sliding the wedge from the second peripheral edge of the base sheet, the apex of the wedge pushes the second flap away from the second peripheral edge to cover the third piece, and wherein a subsequent force exerted on the wedge toward the second peripheral edge causes the second flap to be pushed toward the second peripheral edge to expose at least a portion of the third piece, causing the second piece to become connected to an exposed portion of the third piece to resist further movement of the wedge toward the second peripheral edge.

24. The system of claim 20, wherein the flap has a reinforcing material connected around at least a portion of the free end.

25. The system of claim 20, wherein the flap has sufficient size such that the free end can be folded over the first piece so that the flap completely covers the first piece.

26. The system of claim 20, wherein the piece has two opposed elongated edges and is elongated along a direction substantially parallel to the first peripheral edge of the base sheet, and wherein the fixed end of the flap is connected to the top surface of the base sheet along one of the elongated edges of the piece that is most proximate to the first peripheral edge of the base sheet.

27. The system of claim 26, wherein the flap is rectangular and is elongated along the direction substantially parallel to the first peripheral edge of the sheet.

* * * * *